US006963722B2

(12) United States Patent
Matsumoto et al.

(10) Patent No.: US 6,963,722 B2
(45) **Date of Patent: *Nov. 8, 2005**

(54) SHEET POST-PROCESSING APPARATUS HAVING OFFSET MOUNTING MEANS

(75) Inventors: Yuzo Matsumoto, Ibaraki-Ken (JP); Yoshinori Isobe, Ibaraki-ken (JP); Tsuyoshi Moriyama, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/195,427

(22) Filed: Jul. 16, 2002

(65) Prior Publication Data

US 2002/0191997 A1 Dec. 19, 2002

Related U.S. Application Data

(62) Division of application No. 09/838,220, filed on Apr. 20, 2001, now Pat. No. 6,473,590.

(30) Foreign Application Priority Data

Apr. 4, 2001 (JP) ..... 2000-128421

(51) Int. Cl.[7] ..... G03G 15/00
(52) U.S. Cl. ..... 399/404; 399/405
(58) Field of Search ..... 399/397, 403, 399/404, 405, 407, 408; 270/58.12, 58.27, 270/58; 271/213, 285, 286

(56) References Cited

U.S. PATENT DOCUMENTS

| | | | | |
|---|---|---|---|---|
| 4,073,391 | A | 2/1978 | O'Brien et al. | 214/65 |
| 4,866,487 | A | 9/1989 | Ohuchi et al. | |
| 5,128,762 | A | 7/1992 | Muramatsu et al. | 358/296 |
| 5,535,012 | A | 7/1996 | Matsumoto et al. | 358/400 |
| 5,579,083 | A | 11/1996 | Naito et al. | |
| 5,618,035 | A | 4/1997 | Coombs et al. | 271/213 |
| 5,839,025 | A | 11/1998 | Okauchi et al. | 399/92 |
| 5,839,044 | A | 11/1998 | Taruki | 399/361 |
| 5,848,346 | A | 12/1998 | Takashiro | 399/404 |
| 6,021,305 | A | 2/2000 | Sato et al. | 399/367 |
| 6,203,003 | B1 | 3/2001 | Sato et al. | 271/3.01 |
| 6,219,503 | B1 | 4/2001 | Miyake et al. | 399/45 |
| 6,231,039 | B1 | 5/2001 | Chung | 270/58.01 |
| 6,241,234 | B1 | 6/2001 | Saitoh et al. | 270/58.12 |
| 6,371,472 | B1 | 4/2002 | Miyake et al. | 270/58.14 |

FOREIGN PATENT DOCUMENTS

| | | |
|---|---|---|
| EP | 0 914 959 | 5/1999 |
| EP | 0 959 034 | 11/1999 |

OTHER PUBLICATIONS

Apr. 29, 2005, Office Action issued from The Patent Office of the People's Republic of China in Chinese Patent Application No. 01117155.3.

*Primary Examiner*—Sandra L. Brase
(74) *Attorney, Agent, or Firm*—Fitzpatrick, Cella, Harper & Scinto

(57) ABSTRACT

A sheet processing apparatus comprising a sheet stacking member for stacking a sheet to be discharged, and an offset mounting member for offsetting a plurality of sheet bundles on sides in a sheet bundle takeout direction and in a direction opposite thereto, and mounting the offset bundles onto the sheet stacking member. The offset mounting member mounts the first sheet bundle on the side in the sheet bundle takeout direction. When there is a sheet bundle on the sheet stacking member, the first sheet bundle is mounted by offsetting the first sheet bundle in a direction opposite to that of the last sheet bundle mounted.

3 Claims, 22 Drawing Sheets

SHEET POST-PROCESSING APPARATUS HAVING OFFSET MOUNTING MEANS

This is a divisional application of U.S. patent application Ser. No. 09/838,220, filed on Apr. 20, 2001, now U.S. Pat. No. 6,473,590.

BACKGROUND OF THE INVENTION

1. Field of the Invention

The present invention relates to a sheet post-processing apparatus and an image forming apparatus. More particularly, the invention relates to a sheet post-processing apparatus to be provided in an image forming apparatus forming an image on a sheet, such as a copying machine, a facsimile machine or a printer.

2. Description of Related Art

In the area of image forming apparatuses such as a copying machine, a type is recently proposed, in which a plurality of sheets bearing an image formed sequentially by image forming means are subjected to a prescribed post-processing and discharged onto a stack tray, incorporating a sheet post-processing apparatus known as a finisher.

Post-processing applied in the sheet post-processing apparatus (hereinafter simply referred to as a "finisher") includes, for example, a processing called sorting or offset in which sheets are discharged at positions different between jobs, a staple processing of aligning ends of sheets for each job, and side-marking the ends of the aligned sheets, and a punching processing of punching a hole at ends of the aligned sheets. In the finisher, bundles of the thus post-processed sheets (hereinafter referred to as "sheet bundles") are discharged onto a stack tray, thereby providing convenience to users when an image forming apparatus is shared by a plurality of users through network connection.

A known conventional finisher comprises an intermediate processing tray serving as a sheet stacking base which temporarily stacks sheets for carrying out the above-mentioned sorting or offsetting post-processing, conveying means such as a roller which conveys the sheet having an image formed thereon to the intermediate processing tray, aligning means which performs width-direction alignment for sheets on the intermediate processing tray, and sheet discharging means which discharges the sheet on the intermediate processing tray aligned by the aligning means onto the stack tray. The finisher based on the staple processing or the punching processing is provided with binding means called a stapler for binding the end of the sheet bundle on the intermediate processing tray or with punching means for punching a hole at the end of the sheet bundle on the intermediate processing tray.

In an image forming apparatus having a finisher added thereto, when an image is formed on the sheet in the image forming section, the sheet is mounted on the intermediate processing tray by the conveying means, and width-direction alignment is carried out by the aligning means on the intermediate processing tray. The sheet is then discharged by the sheet discharging means such as a discharging belt onto the stack tray.

When a selection is made to conduct offsetting the discharged sheet bundle for each job, in the conventional finisher, the aligning means is controlled so that the discharging position of the sheet bundle in the preceding job and the discharging position of the sheet bundle in the current job are different (shift) from each other. For example, the aligning means is controlled for each sheet stacked onto the intermediate processing tray so that the sheet is at a position on the near side relative to the apparatus main body in the preceding job, and the aligning means is controlled in the next job so that the sheet is positioned to the far side relative to the apparatus main body. In the following job, the aligning means is controlled so that the sheet is positioned on the near side.

However, in the conventional image forming apparatus as described above, when offsetting of the sheet bundle is selected upon execution of a new job, after the end of a prescribed job, from the state in which the sheet bundle has been removed from the stack tray, if the sheet bundle has been aligned to the near side in the immediately preceding job, the sheet bundle in the new job is started from the far-side alignment. When taking out the sheet bundle mounted on the stack tray in the offset state, therefore, it may become difficult to take out the lowermost sheet bundle, or the lowermost sheet is often left behind in some cases.

BRIEF SUMMARY OF THE INVENTION

Accordingly, the present invention has an object to provide a sheet post-processing apparatus which solves the inconveniences such as leaving behind or difficulty in taking out the lowermost sheet bundle from among the discharged sheet bundles, and an image forming apparatus having the same.

In accordance with an aspect of the present invention, there is provided a sheet post-processing apparatus comprising sheet stacking means for stacking a sheet to be discharged, and offset mounting means for offsetting a plurality of sheet bundles on sides in a sheet bundle takeout direction and in a direction opposite thereto, and mounting the offset bundles onto the sheet stacking means, wherein the offset mounting means mounts the first sheet bundle on the side in the sheet bundle takeout direction.

A main concrete configuration of the sheet post-processing apparatus and the image forming apparatus of the invention comprises a sheet stacking base which temporarily stacks sheets, conveying means for conveying the sheets each having an image formed thereon to the sheet stacking base, aligning means for aligning the sheets in the sheet width direction for every run of conveyance by the conveying means on the sheet stacking base, at two or more aligning positions which can be set in the sheet width direction, sheet discharging means for discharging the sheets on the sheet stacking base aligned by the aligning means, and aligning position control means for controlling the aligning position of the aligning means so that at least the first sheet from among the sheets conveyed onto the sheet stacking base is at a position closest to this side relative to the apparatus main body.

According to the present invention, as described above, it is possible to provide a sheet post-processing apparatus which solves the inconveniences such as leaving behind or difficulty in taking out a lowermost sheet bundle from among the discharged sheet bundles, and an image forming apparatus having such a sheet post-processing apparatus.

DETAILED DESCRIPTION OF THE INVENTION

Hereinafter, a preferred embodiment of the invention will be described in detail with reference to the drawings.

The following embodiment covers an image forming apparatus (copying machine) comprising an image reading means for reading an image of an original, an electrophotographic-type image forming means for forming an image on a sheet, and a finisher which conducts a sorting processing and a staple processing of sheets bearing an image formed by the image forming means.

Figure 1:
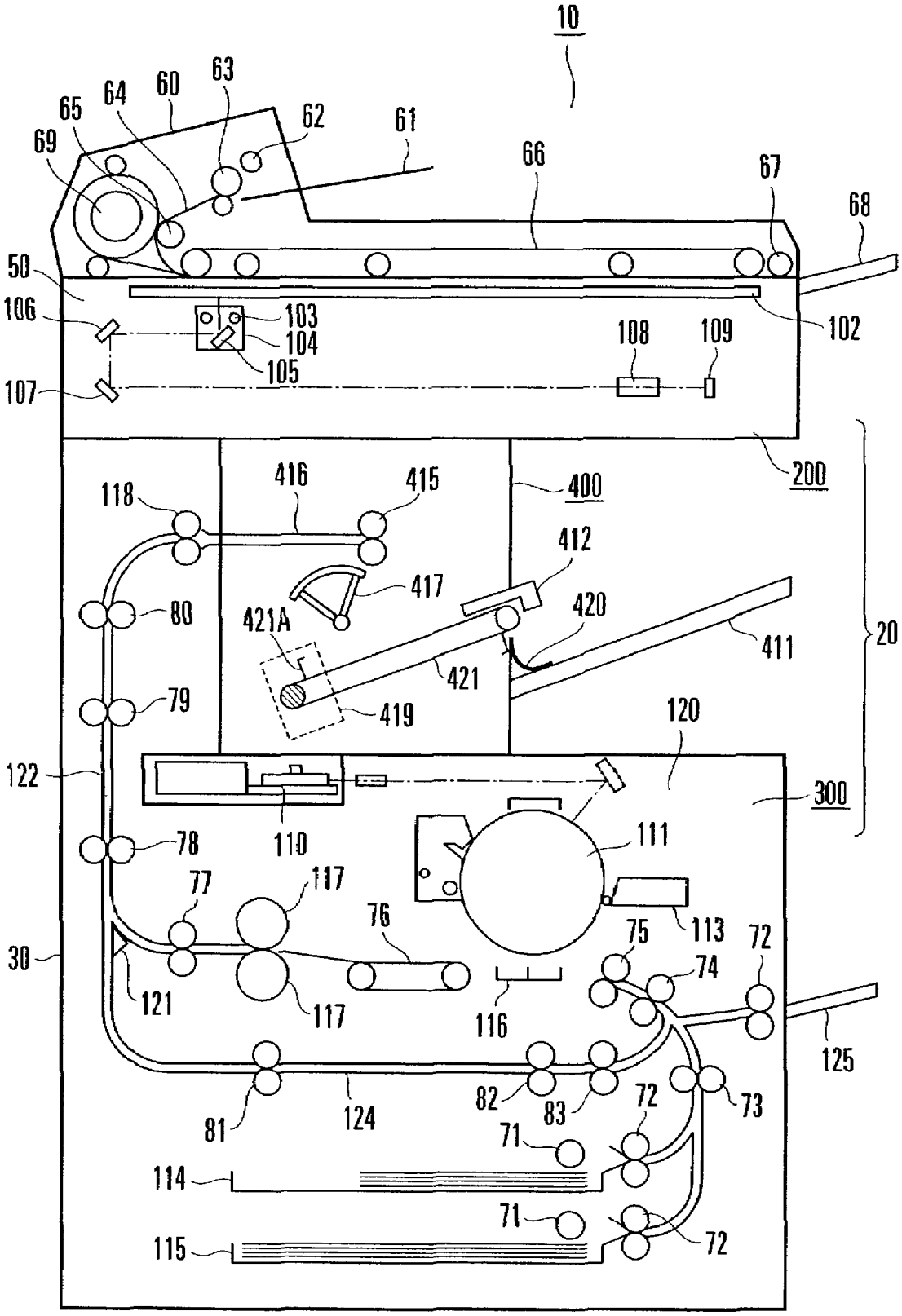
FIG. 1 is a sectional view illustrating a whole configuration of a copying machine to which the present invention is applied.

First, the whole configuration of the copying machine of the embodiment will be described. As shown in FIG. 1, the copying machine 10 of the embodiment comprises an image reader 200 serving as an image reading means for reading an image of an original, and a printer 300 serving as image forming means for forming an image on a sheet, and a copying machine main body 20 is composed of the image reader 200 and the printer 300. In the present embodiment, the image reader 200 is arranged above the apparatus main body 30 which is a frame part, and the printer 300 is arranged below the apparatus main body 30.

In the copying machine of the present embodiment, there is provided a finisher 400 serving as a sheet post-processing apparatus which applies a post-treatment to a sheet bearing the image formed thereon by the printer 300 and discharges the same. As shown in FIG. 1, the finisher 400 is arranged at a position between the image reader 200 and the printer 300 in the apparatus main body 30 so as not to project from the image reader 200 and the printer 300.

First, the configuration of the image reader 200 of the copying machine main body 20 will be described. The image reader 200 of the copying machine main body 20 comprises a scanner part 50 for reading an image of an original and an original feeding part 60 for conveying and feeding the set original to the scanner part 50, and has a configuration in which the original feeding part 60 can be opened or closed to the scanner part 50.

The scanner part 50 of the image reader 200 comprises a platen glass 102 on which the original is placed, a scanner unit 104 having a lamp 103 serving as a light source and a mirror 105 and arranged to be movable to the right and to the left in FIG. 1, mirrors 106 and 107 which reflect and return the reflected light from the scanner unit 104, a lens 108 which condenses the reflected light from the individual mirrors 105 to 107, and an image sensor 109 which photoelectrically converts the reflected light having passed through the lens 108.

In the scanner part 50, the light of the lamp 103 of the scanner unit 104 is irradiated onto the original placed with the imaged surface thereof directed downward onto the platen glass 102 through the opening/closing operation of the original feeding part 60, and the reflected light from the original is directed to an image sensor 109 via the mirrors 105, 106 and 107 and the lens 108, whereby an image of the original is read in.

The original feeding part 60 of the image reader 200 has an original stacking tray 61 onto which a plurality of originals are stackable, a pickup roller 62 arranged to come into contact with the uppermost surface of the original stacked onto the original stacking tray 61, a separating roller pair 63 which separates the original fed by the pickup roller 62 into a single sheet, a U-turn path 64 which guides the original separated by the separating roller pair 63 so as to make a U-turn, a conveying roller 65 arranged on the U-turn path 64, a belt conveying part 66 which conveys the original conveyed by the conveying roller 65 along the upper surface of the platen glass 102 of the scanner part 50, an original discharging roller 67 and an original discharging tray 68 which are arranged on the rear stage of the belt conveying part 66, a driving motor 69 which drives the rollers and the belt conveying part 66, etc.

In the original feeding part 60, a plurality of originals are set with image-bearing sides thereof upward on the original stacking tray 61. Only the uppermost original is separated by the pickup roller 62 and the separating roller pair 63, and is fed to the U-turn path 64. The original is wrapped on the U-turn path 64 with the surface thereof bearing the image directed downward, and the image is read out by the scanner part 50 while the original is conveyed to the right in FIG. 1 by the belt conveying part 66 along the platen glass 102. Then, the original is discharged by the original discharging roller 67 onto the original discharging tray 68. In the image reader 200, sequential repetition of this operation for a plurality of originals permits readout of the image by the scanner part 50 while feeding the plurality of originals automatically to the original feeding part 60. The image of the original read out by the image sensor 109 of the scanner part 50 is subjected to an image processing, and is sent in the form of image signals to an exposure control part 110 (described later) on the side of the printer 300.

The configuration of the printer 300 of the copying machine main body 20 will now be described. The printer 300 comprises the exposure control part 110 which outputs a laser beam according to an image signal, a photosensitive drum 111 which forms an electrostatic latent image on the basis of the laser beam from the exposure control part 110, a developing unit 113 which develops the electrostatic latent image formed on the photosensitive drum 111 to generate a toner image, a transfer unit 116 which transfers the thus-generated toner image onto the sheet, and a fixing part 117 for fixing the toner image transferred onto the sheet. These components form an image forming part 120 of the electrophotographic type.

The printer 300 has, furthermore, upper and lower sheet stacking cassettes (hereinafter simply referred to as "cassettes") 114 and 115 drawably arranged relative to the apparatus main body 30 to serve as a sheet feeding part which feeds the sheets to the aforementioned image forming part 120, and a manual feeding part 125 for manually feeding various sheets one by one.

In the printer 300, as sheet feeding and conveying means for feeding sheets either from the cassettes 114 and 115 or from the manual feeding part 125, conveying the sheets to the image forming part 120, and feeding the sheets bearing an image formed thereon at the image forming part 120 to the finisher 400, there are arranged a pickup roller 71, a separating roller pair 72, conveying roller pairs 73 to 75 which convey the sheets from the separating roller pair 72 to the image forming part 120, a belt conveying part 76 arranged between the photosensitive drum 111 of the image forming part 120 and the fixing part 117, a conveying path 122 for conveying the sheets having passed through the fixing part 117 to the finisher 400, and conveying roller pairs 77 to 80 and a discharging roller 118 arranged on the conveying path 122.

The printer 300 has, furthermore, as sheet re-feeding means for conducting the so-called two-side printing of forming an image in the image forming part 120 on a surface opposite to the surface bearing the image formed thereon for the sheets having the image formed at the image forming part 120, a conveying roller pair 78 of which the sheet conveying direction is switchable between forward and back (hereinafter referred to as the "switch-back roller"), a two-side conveying path 124 arranged between the image forming part 120 and the cassette 114, a flapper 121 for preventing the sheet conveyed in the reverse direction by the switch-back roller 78 from flowing back to the fixing part 117 side, and re-feeding rollers 81 to 83 arranged on the two-side conveying path 124.

The image forming operation and the conveying operation of the sheet in the printer 300 will now be described. In the printer 300, a laser beam corresponding to an image signal for the original image generated in the scanner part 50 is outputted in the exposure control part 110 of the image forming part 120. In the printer 300, this laser beam is irradiated onto the photosensitive drum 111. Then, an electrostatic latent image is formed on the photosensitive drum 111, and this electrostatic latent image is developed into a toner image by the developing unit 113.

In the printer 300, on the other hand, the sheet is fed either from the aforementioned cassettes 114 and 115 of the sheet feeding part or the manual feeding part 125, and the fed sheet is sent to the space between the photosensitive drum 111 and the transfer unit 116 of the image forming part 120 via the conveying roller pairs 74 and 75. The developer (toner) on the photosensitive drum 111 is transferred by the transferring unit 116 onto the sheet, so that a transfer processing of the image is performed on the basis of the original image.

The sheet onto which the developer has been transferred is then conveyed by the belt conveying part 76 to the fixing part 117, where the fixing of the developer is performed. The sheet having passed through the fixing part 117 is conveyed by the conveying roller pairs 77 to 80 through the conveying path 122, is directed to the discharging roller 118, and is discharged from the printer 300 by the discharging roller 118 in a state in which the surface bearing the image with the fixed developer is directed downward (face down). Discharging face down permits achievement of the positive page sequence upon forming the images sequentially from the top page as in the use of the original feeding part 60 or when printing computer-output images.

The sheet bearing the image already formed thereon discharged by the discharging roller 118 from the printer 300 is then sent to the finisher 400 for binding. Subsequent operations will be described later.

The process of forming images on the both sides of a sheet comprises the steps of once directing the sheet having passed through the fixing part 117 to the conveying path 122 via the conveying roller pair 77 and the switch-back roller 78, then actuating the flapper 121 and reversely rotating the switch-back roller 78, thereby switching the sheet back to the two-side conveying path 124, sending the sheet again to the image forming part 120 with the image-bearing surface downward by the use of the re-feeding rollers 81 to 83 and the conveying roller pairs 74 and 75, and discharging the sheet upon completion of image forming on the second side from the printer 300 as described above.

The control part of the copying machine 10 will now be described with reference to the block diagrams of FIGS. 2 and 3. The control part of the copying machine 10 comprises a CPU circuit part 150 having a CPU, an ROM 151 and an RAM 152, an original transport control part 101 which controls the original feeding part 60 of the aforementioned image reader 200, an image reader control part 201 which controls the scanner part 50 of the image reader 200, an image signal control part 202 which controls image signals generated in the image reader 200, a printer control part 301 which controls the above-mentioned printer 300, and a finisher control part 401 which controls the finisher 400 described in detail later.

Figure 2:
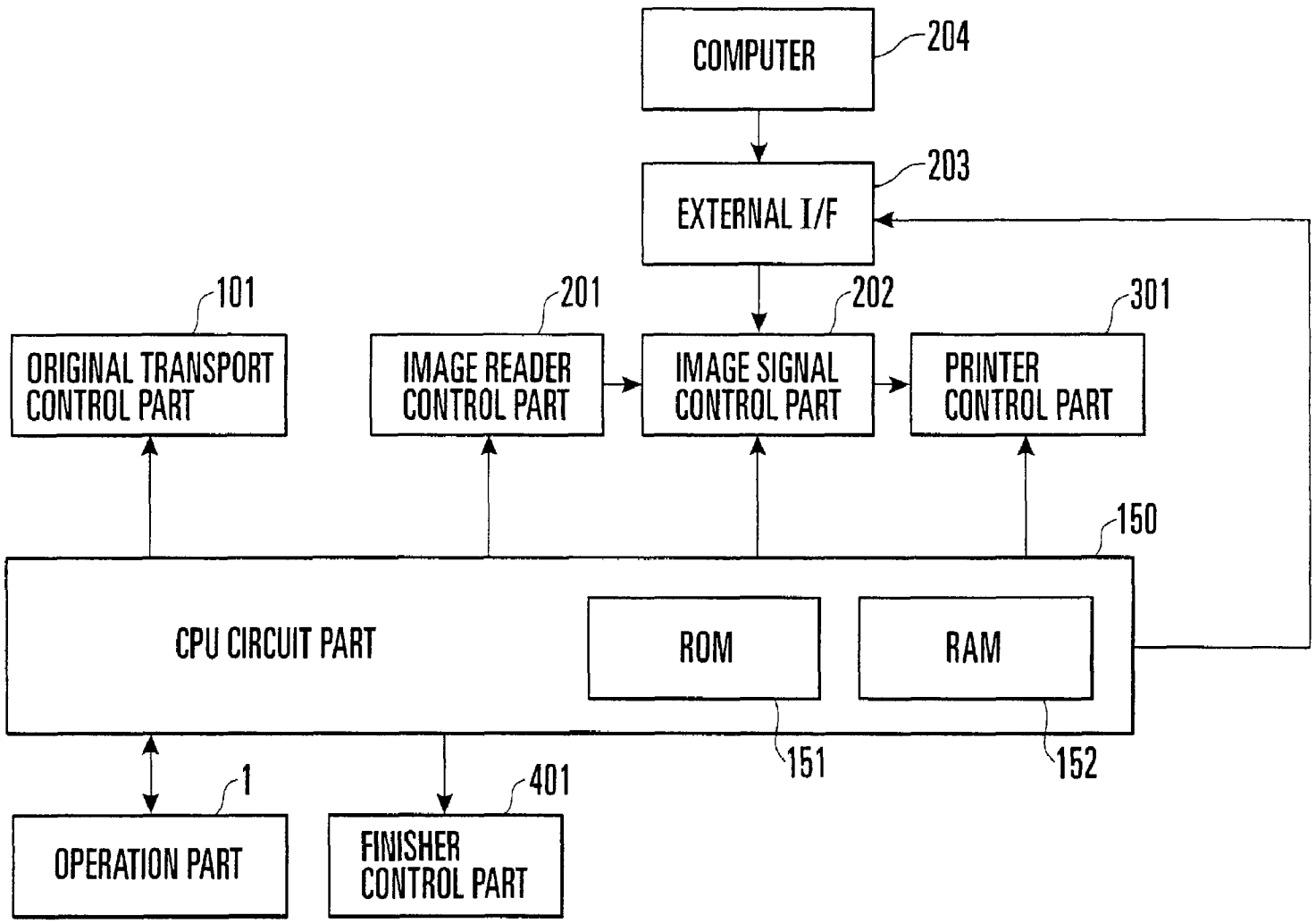
FIG. 2 is a circuit configuration diagram showing the control block of the copying machine.

As shown in FIG. 2, an operation part 1 is connected to the CPU circuit part 150, and the parts of the copying machine 10 are operated on the basis of operating input signals from the operation part 1. The operation part 1 comprises, for example, various key-switches and a display panel (see FIG. 11(*a*)), and is arranged above the copying machine main body 20.

The CPU circuit part 150 has an object to control the entire copying machine 10, and governs operations of the original transport control part 101, the image reader control part 201, the image signal control part 202, the printer control part 301, the finisher control part 401, and the external I/F 203 connected to the image signal control part 202. The RAM 152 of the CPU circuit part 150 is used as an area temporarily retaining control data or an operating area for arithmetic operation necessary for control.

In the copying machine 10, information about an image read out by the image sensor 109 of the scanner part 50 is outputted from the image reader control part 201 to the image signal control part 202, and after application of a prescribed processing at the image signal control part 202, is outputted to the printer control part 301, for being fed to the exposure control part 110.

The copying machine 10 of the present embodiment can be used also as a printer through connection of the computer 204 serving as a host terminal to the image signal control part 202 via the external I/F 203. In this case, the image reader control part 201 is not used, but print data issued from the computer 204 are outputted to the image signal control part 202 via the external I/F 203. After application of a prescribed processing at the image signal control part 202, the data are outputted to the printer control part 301, and are fed to the above-mentioned exposure control part 110.

Figure 3:
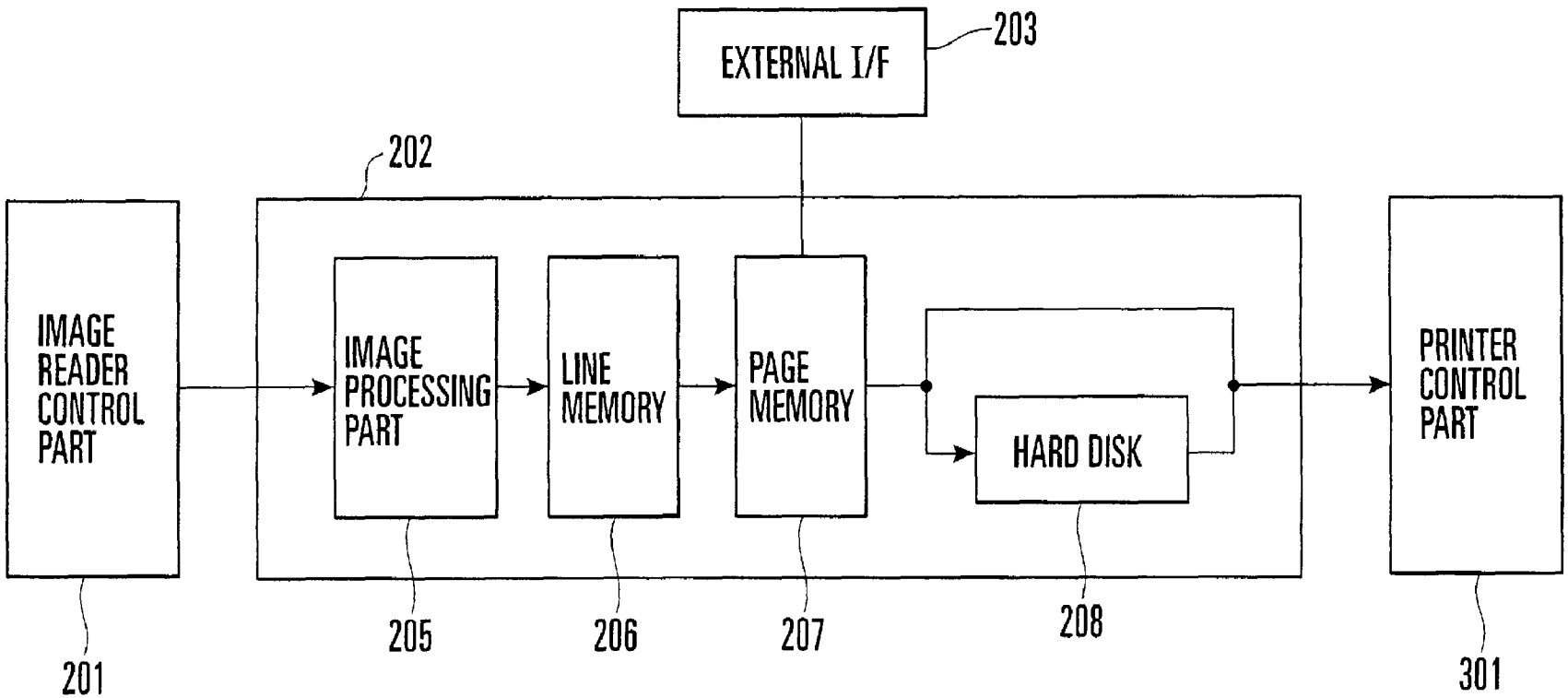
FIG. 3 is a block circuit diagram of an image signal control part.

FIG. 3 illustrates the configuration of the image signal control part 202. The image signal control part 202 has, as shown in FIG. 3, an image processing part 205 connected to the image reader control part 201, a line memory 206 connected to the rear stage of the image processing part 205, a page memory 207 connected to the external I/F 203 and the rear stage of the line memory 206, and a hard disk 208 connected to the rear stage of the page memory 207.

In the image signal control part 202, correction of an image or edition in accordance with a setting by the operation part 1 shown in FIG. 2 is performed by the image processing part 205. The image signal after processing is outputted to the printer control part 301 via the line memory 206 and the page memory 207. The hard disk 208 is used as required, for example, when changing the page sequence.

Figure 4:
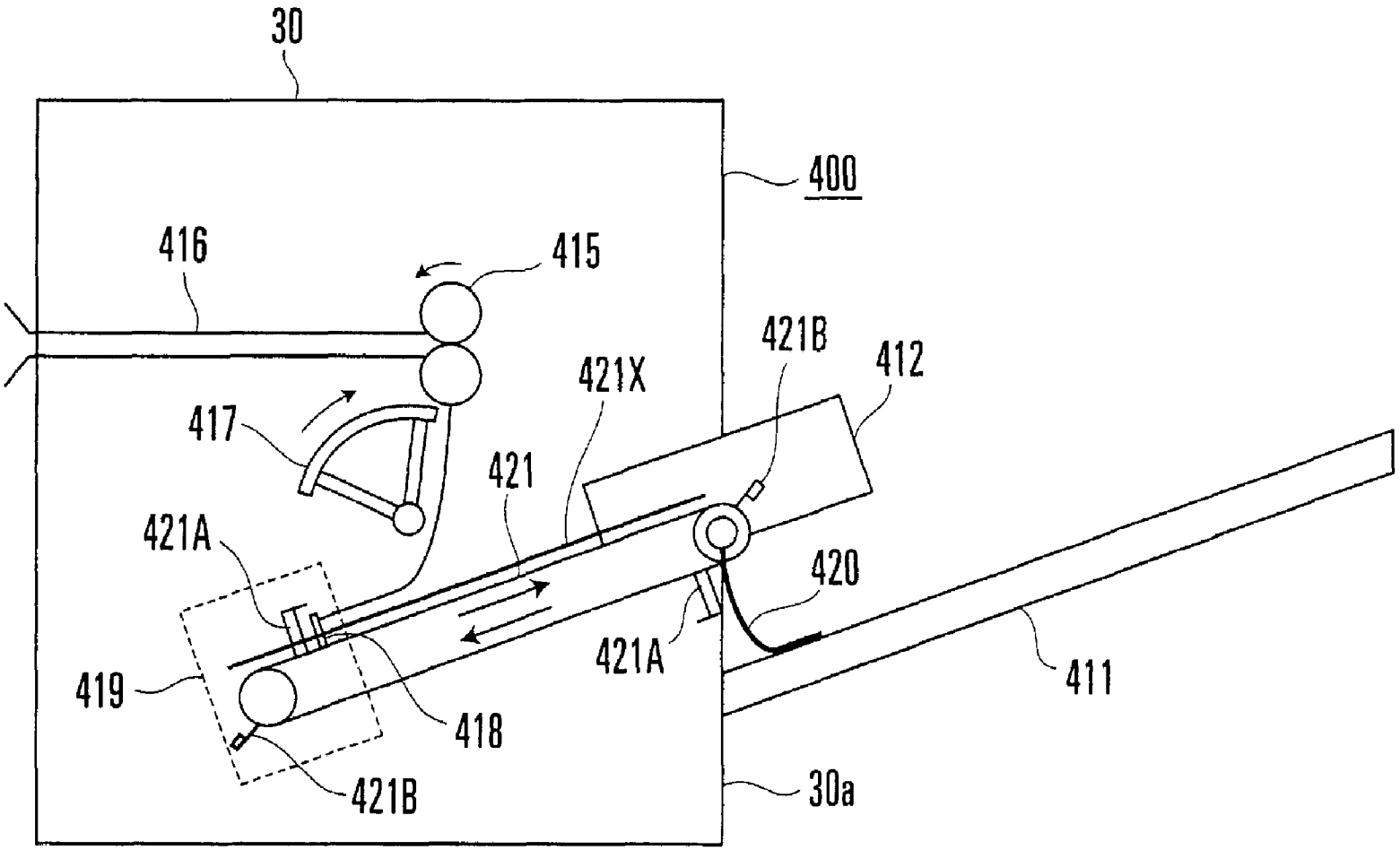
FIG. 4 is a sectional view illustrating the configuration of a finisher.

The configuration of the finisher 400 will now be described. FIG. 4 illustrates only the finisher 400 extracted from the copying machine 10.

The finisher 400 of the embodiment comprises a path 416 through which the image-formed sheet discharged from the discharging roller 118 of the printer 300 is fed, a discharging roller 415, arranged on the downstream side of the path 416, discharging sheets from the path 416, a bundle discharging belt 421 arranged in slant below the discharging roller 415, an aligning plate 412 serving as aligning means, a fan-shaped return roller 417 arranged between the discharging roller 415 and the bundle discharging belt 421, a staple unit 419 arranged on the upstream side of the bundle discharging belt 421, and a stack tray 411 liftably arranged on the downstream side of the bundle discharging belt 421.

In the finisher 400, a low-friction intermediate processing tray 421X is provided at a position higher by a few mm in parallel with the bundle discharging belt 421. The intermediate processing tray 421X has a function of serving as a sheet stacking base which temporarily stacks the sheets. In the finisher 400, the lengths of the bundle discharging belt 421 and the intermediate processing tray 421X may sometime be insufficient to permit stacking of the sheets. An intermediate processing tray stacking auxiliary plate 421B is, therefore, provided on the bundle discharging belt 421 to make up with the shortage of length of the sheet stacking area of the intermediate processing tray 421X.

The staple unit 419 shown in FIG. 4 is provided on this side (in the direction perpendicular to the drawing plane of FIG. 4) relative to the apparatus main body 30 so as to permit application of staple processing to the left top corner of the sheet mounted and stacked on the bundle discharging belt 421 and the intermediate processing tray 421X.

The aligning plates 412 serving as aligning means are provided on this side and on the deeper side relative to the apparatus main body 30, and conduct width-direction alignment of the sheets mounted and stacked on the bundle discharging belt 421 and the intermediate processing tray 421X. The aligning plates 412 can perform offset stacking of the sheets by dividing the same into those on this side and the deeper side relative to the apparatus main body 30 for stacking onto the stack tray 411 and the intermediate processing tray 421X. The configuration and operation of the aligning plate 412 will be described in detail later.

In the finisher 400, the sheet having the imaged already formed thereon discharged from the discharging roller 118 of the printer 300 is sent to the discharging roller 415 through the path 416, and this sheet is discharged by the discharging roller 415 outside the path 416. The leading end of the discharged sheet P in the discharging direction comes on the stack tray 411 as shown in FIG. 16, and the rear end thereof in the discharging direction moves to the bottom left in FIG. 16 along the slant of the intermediate processing tray 421X.

Figure 16:
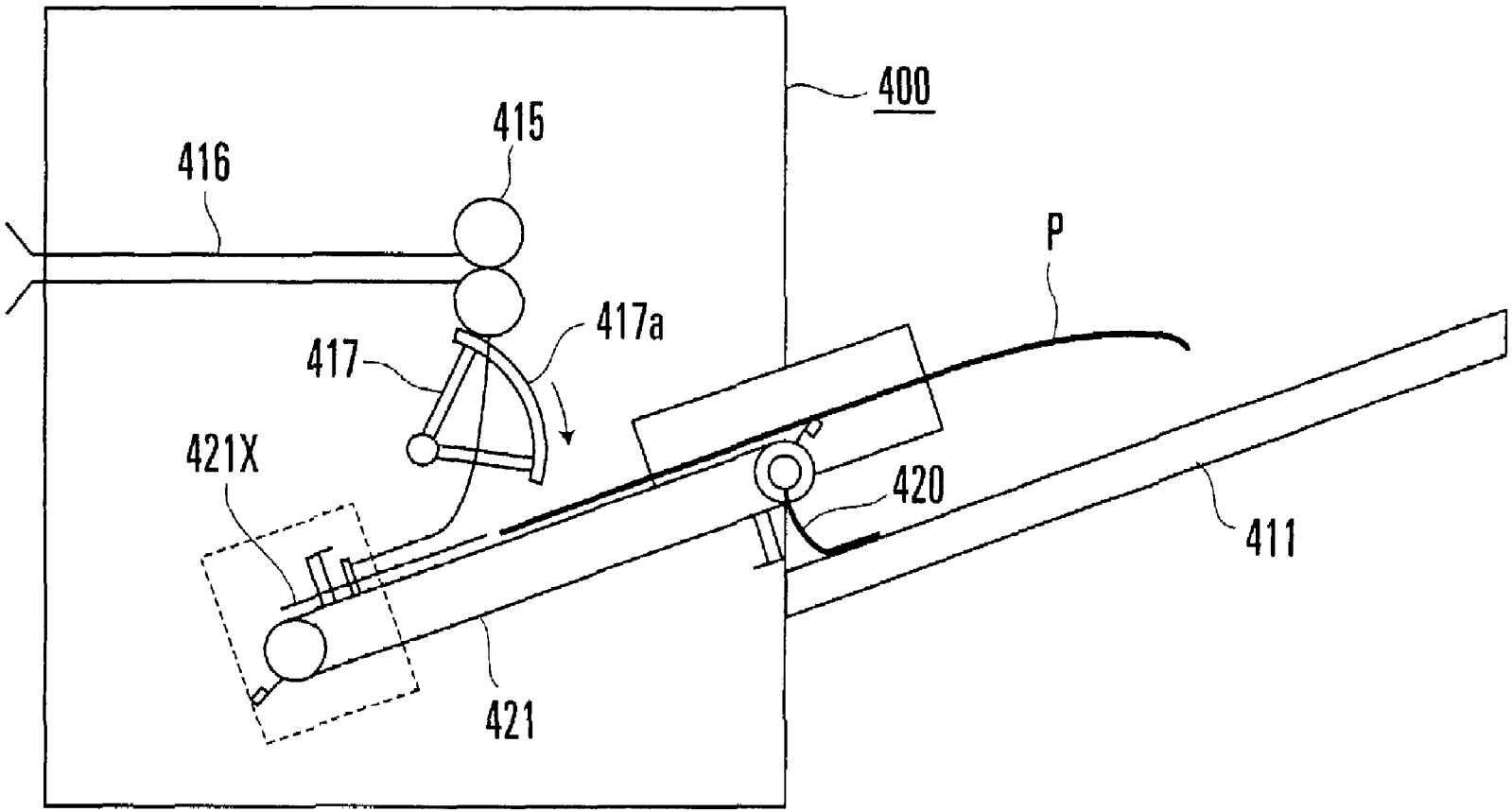
FIG. 16 illustrates the state in which a sheet is discharged by a discharging roller onto the intermediate processing tray.
Figure 17:
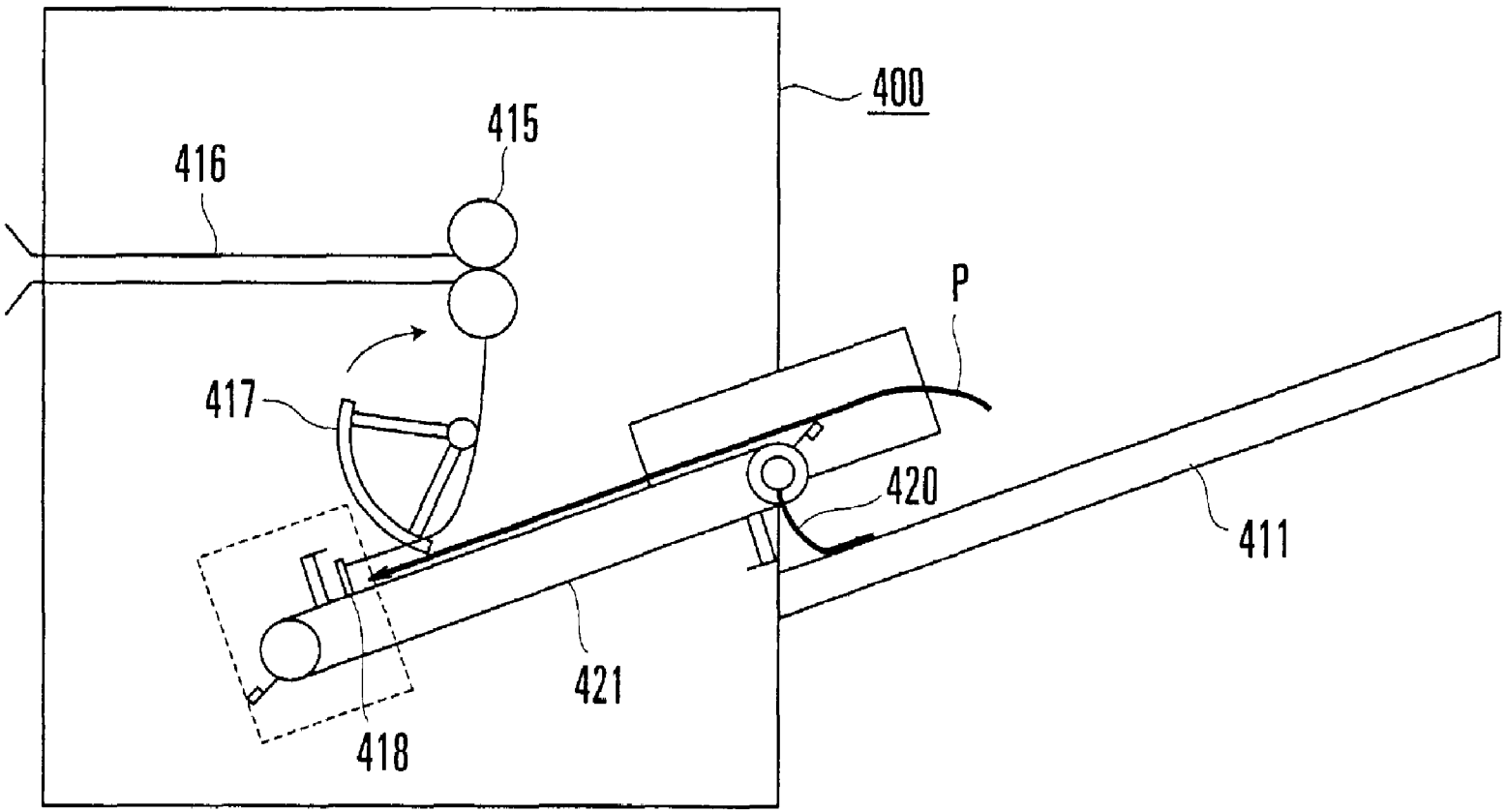
FIG. 17 illustrates operations upon returning, by the return roller, the sheet discharged by the discharging roller onto the intermediate processing tray.

In the finisher 400, the fan-shaped return roller 417 rotates from the state shown in FIG. 16 clockwise in FIG. 16. As a result, a frictional member provided in an arcuate part 417*a* of the return roller 417 comes into contact with the sheet P discharged onto the intermediate processing tray 421X, and this frictional member moves the sheet toward the bottom left, thus causing an end of the sheet P to abut on a fixed-type stopper plate 418. As a result, the image-formed sheet is temporarily mounted on the intermediate processing ray 421X, and in this state, a post-processing such as sorting or staple processing is applicable. By repeating the operation for each sheet discharged from the printer 300, the plurality of sheets having images formed thereon are stacked onto the intermediate processing tray 421X, forming sheet bundles, and each time a job for a prescribed member of prints is completed, the bundle discharging belt 421 rotates clockwise in FIG. 4, thus causing the sheet bundle on the intermediate processing tray 421X to be discharged onto the stack tray 411.

Figure 19:
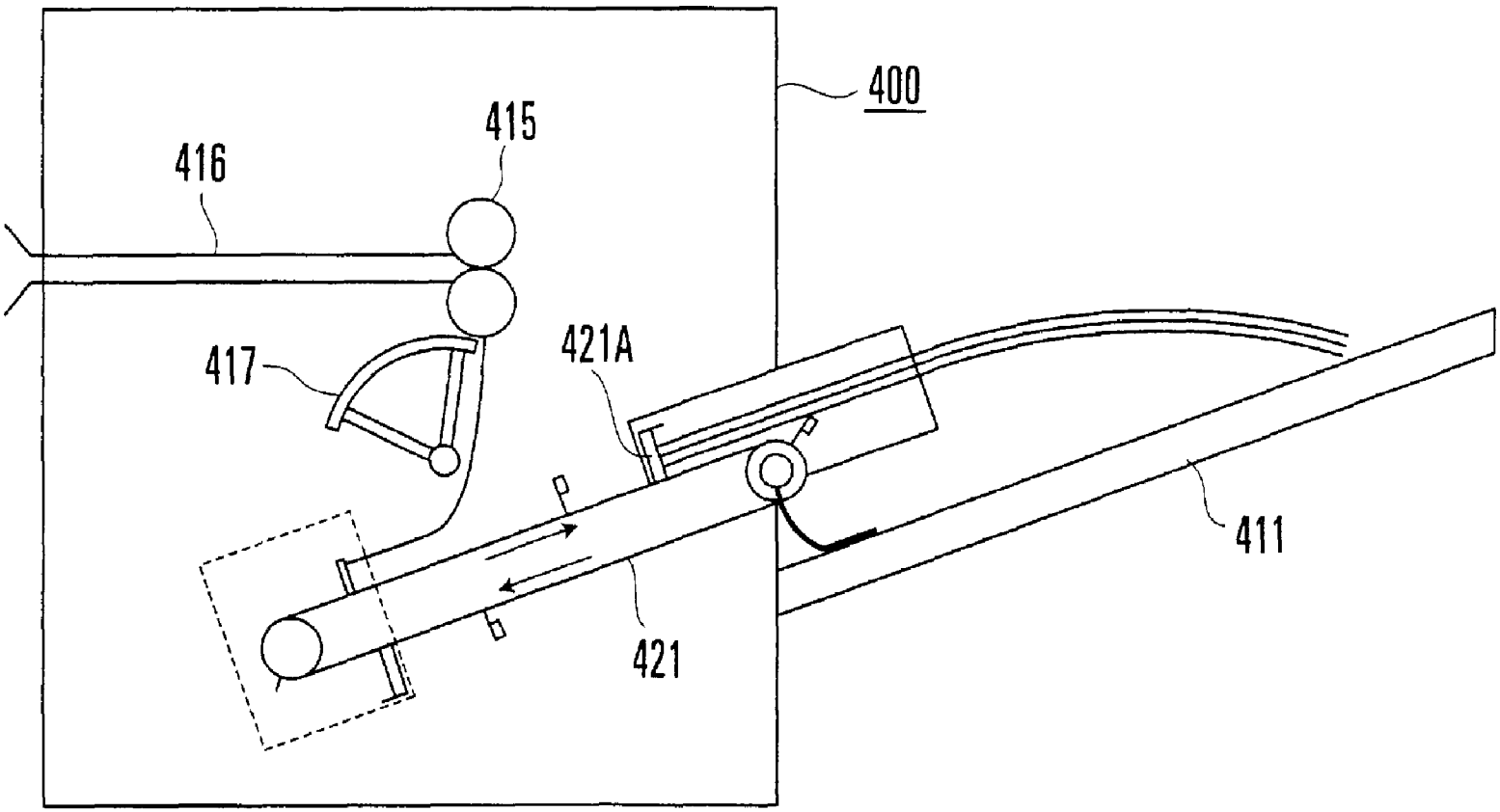
FIG. 19 illustrates operations upon discharging sheet bundles stacked onto the intermediate processing tray by the bundle discharging belt onto the stack tray.

The discharging operation of the sheet bundle in the finisher 400 will now be described. In the finisher 400, as shown in FIG. 4, two sets of bundle discharging levers 421A are integrally formed on the bundle discharging belt 421. When the bundle discharging belt 421 rotates, the bundle discharging levers 421A move inside a notch (not shown) in provided in the intermediate processing tray 421X. When the bundle discharging belt 421 is rotation-driven by a motor M2 shown in FIG. 5 clockwise in FIG. 4 by half a turn, the sheet bundle on the intermediate processing tray 421X is pushed up by the bundle discharging lever 421A as shown in FIG. 19, and is discharged onto the stack tray 411.

Figure 8:
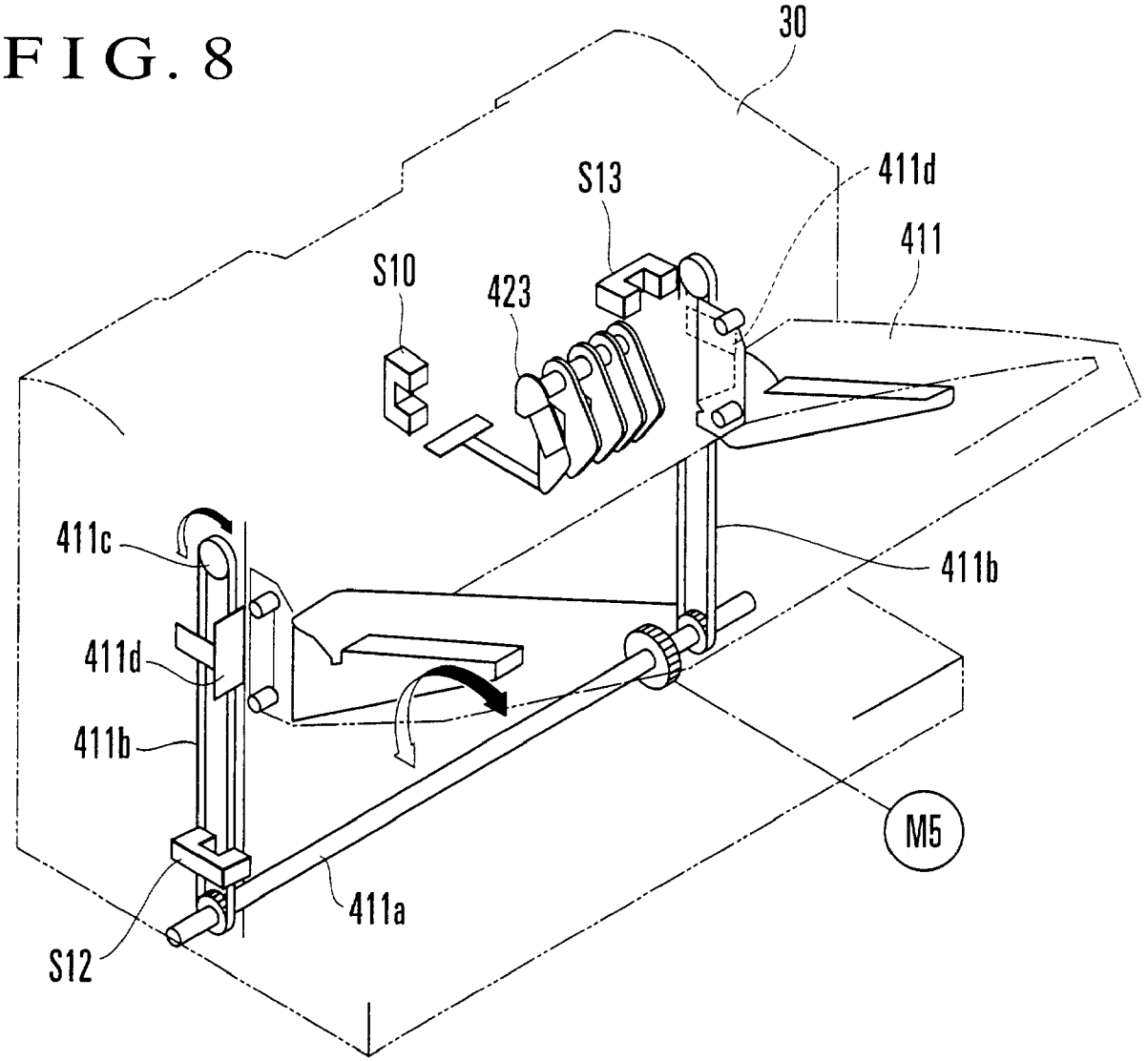
FIG. 8 illustrates the configuration of a lifting mechanism of a stack tray.

The stack tray 411 moves up and down relative to the wall 30*a* of the apparatus main body 30, by being driven by the motor M5 shown in FIG. 8. As shown in FIG. 4, a sheet bundle holding member 420 made of, for example, an elastic material is arranged rotatably above the stack tray 411. When the sheet bundle is discharged onto the stack tray 411, the stack tray 411 descends by a prescribed amount, by being driven by the motor M5. At the same time, the sheet bundle holding member 420 is rotation-driven clockwise in FIG. 4 by the motor M2. Subsequently, the stack tray 411 is lifted by a prescribed amount, by being driven by the motor M5, and this enables the sheet bundle holding member 420 to stop the sheet upper surface. As result, the sheet on the stack tray 411 is prevented from being pushed out to the right by the sheet next to be discharged onto the stack tray 411.

In the finisher 400, a plurality of sensors and motors are provided, and various component parts are operated on the basis of detection results of the individual sensors and driving force of the individual motors. The sensors and the motors in the finisher 400 will be described.

Figure 5:
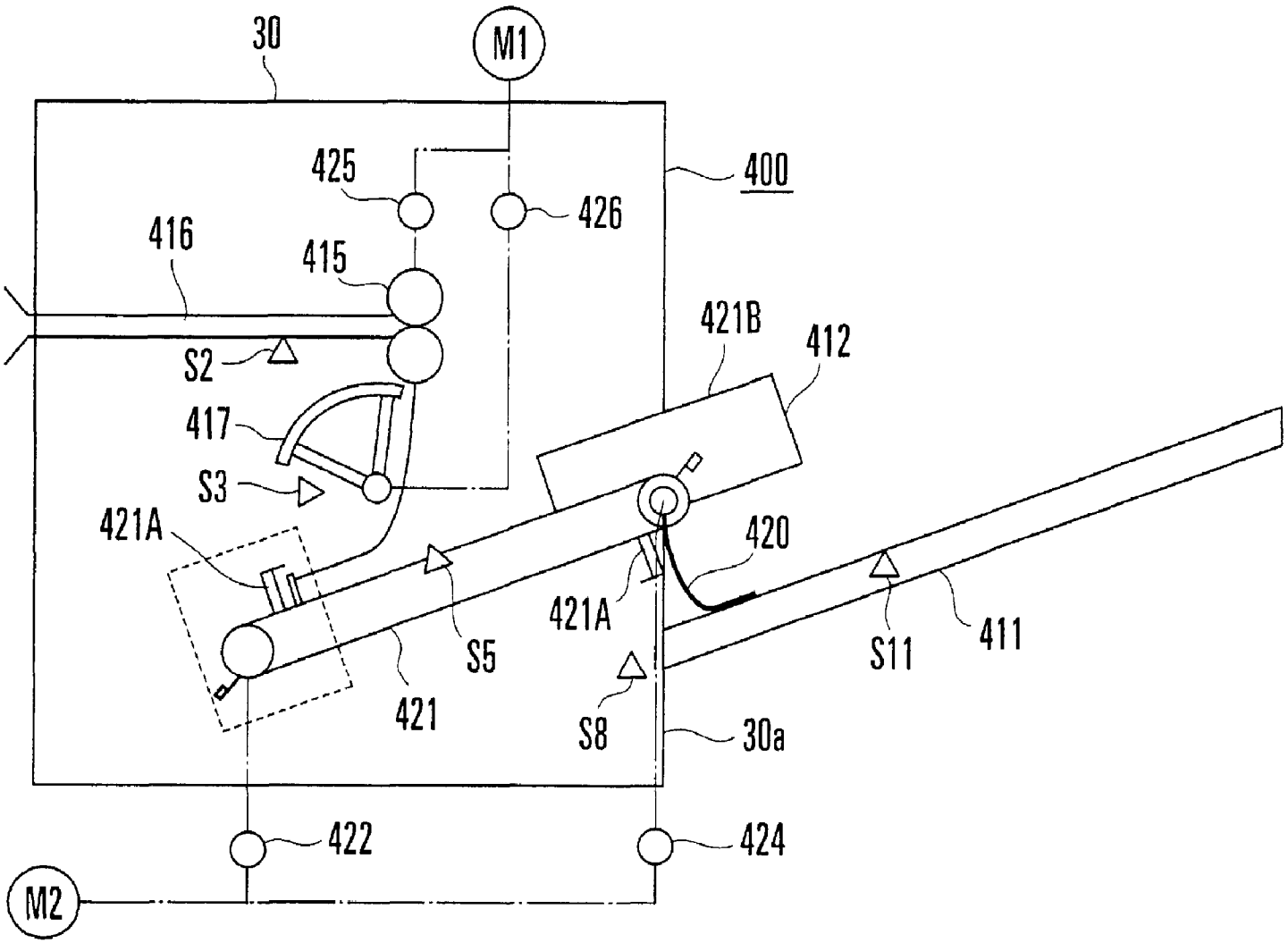
FIG. 5 is a sectional view explaining a sensor and a motor in the finisher.

FIG. 5 illustrates the sensors and the motors in the finisher 400. Five motors M1 to M5 and sensors are provided in the finisher 400. Among others, FIG. 5 shows two motors M1 and M2 and five sensors S2, S3, S5, S8 and S11. The other motors and sensors will be described later.

The motor M1 drives the discharging roller 415 and the return roller 417 (hereinafter referred to as the "roller driving motor"), and the motor M2 drives the sheet bundle holding member 420 and the bundle discharging belt 421 (hereinafter referred to as the "intermediate tray driving motor").

In the finisher 400, the discharging roller 415, via a one-way clutch 425, and the return roller 417, via a one-way clutch 426, are selectively rotation-driven by the roller driving motor M1. More specifically, when the roller driving motor M1 rotates forward, the one-way clutches 425 and 426 are turned on and off, respectively, and only the discharging roller 415 rotates so as to discharge the sheet to the right in FIG. 5. When the motor M1 rotates backward, on the other hand, the one-way clutches 425 and 426 are turned off and on, respectively, and only the return roller 417 rotates clockwise in FIG. 5.

In the finisher 400, furthermore, the bundle discharging belt 421, via the one-way clutch 422, and the sheet bundle holding member 420, via the one-way clutch 424, are selectively rotation-driven by the intermediate tray driving motor M2, respectively. More specifically, when the intermediate tray driving motor M2 rotates forward, the one-way clutches 422 and 424 are turned on and off, respectively, and only the bundle discharging belt 421 rotates clockwise in FIG. 5. When the intermediate tray driving motor M2 rotates backward, on the other hand, the one-way clutches 422 and 424 are turned off and on, respectively, and only the sheet bundle holding member 420 rotates clockwise in FIG. 5.

In the present embodiment, as described above, the discharging roller 415 and the return roller 417 are driven by a motor, and the bundle discharging belt 421 and the sheet bundle holding member 420 are driven by another motor, thus permitting a reduction in cost.

The sensors shown in FIG. 5 will now be described. The sensor S3 detects a flag (not shown) attached to the rotation shaft of the return roller 417 (hereinafter referred to as the "flag detecting sensor"). In the finisher 400, whether or not the return roller 417 is at the home position thereof is detected by the flag detecting sensor S3.

The sensor S2 detects the leading and rear ends of the sheet fed to the path 416 (hereinafter referred to as the "sheet passage detecting sensor"). In the finisher 400, rotation of the discharging roller 415 is started in response to the detection of the leading end of the sheet by the sheet passage detecting sensor S2, and control is applied so as to decelerate and then stop the discharging roller 415 at a prescribed timing as described later.

In the finisher 400, a sheet presence detecting sensor S5 which detects the presence of a sheet on the bundle discharging belt 421 (intermediate processing tray) and a sheet presence detecting sensor S11 which detects the presence of a sheet on the bundle discharging belt 421 are provided. Furthermore, as shown in FIG. 5, a lever position detecting sensor S8 which detects whether or not the bundle discharging lever 421A is at the home position is arranged below the bundle discharging belt 421.

The home positions of the return roller 417 and the bundle discharging lever 421A are positions shown in FIG. 5. The home position of the bundle discharging lever 421A is in the downstream a little in the conveying direction of a stopper plate 418.

The return roller 417 is controlled so that, every time a sheet is discharged by the conveying roller 415, the return roller 417 makes just one turn clockwise starting from the home position shown in FIG. 5 and stops. During rotation of the return roller 417, as described above, the discharging roller 415 does not rotate.

In the finisher 400, as described above, the bundle discharging belt 421 makes half a turn when discharging a sheet bundle on the intermediate processing tray. If it is allowed to rotate another half a turn, the bundle discharging lever 421A would collide with the sheet bundle stacked onto the stack tray 411. In the finisher 400, therefore, the stack tray 411 is controlled at a position where the stack tray 411 is at a distance suitable for falling upon discharging the sheet bundle. At this position, the upper surface of the sheet bundle stacked on the stack tray 411 crosses the locus of the bundle discharging lever 421A.

In the present embodiment, control is performed so that the bundle discharging belt 421 (intermediate tray driving motor M2) is temporarily stopped at a position where the bundle discharging lever 421A becomes substantially parallel with a straight portion of the bundle discharging belt 421 (substantially parallel with the intermediate processing tray 421X) (see FIG. 6), the stack tray 411 is once lowered, and then the bundle discharging belt 421 is rotation-driven again to make the balance of turn and stops at the home position. As a result of this operation, in the present embodiment, it is possible to prevent the bundle discharging lever 421A from entangling the sheet on the stack tray 411, and to prevent the rear end of the sheet bundle from remaining on the bundle discharging belt 421.

Figure 7:
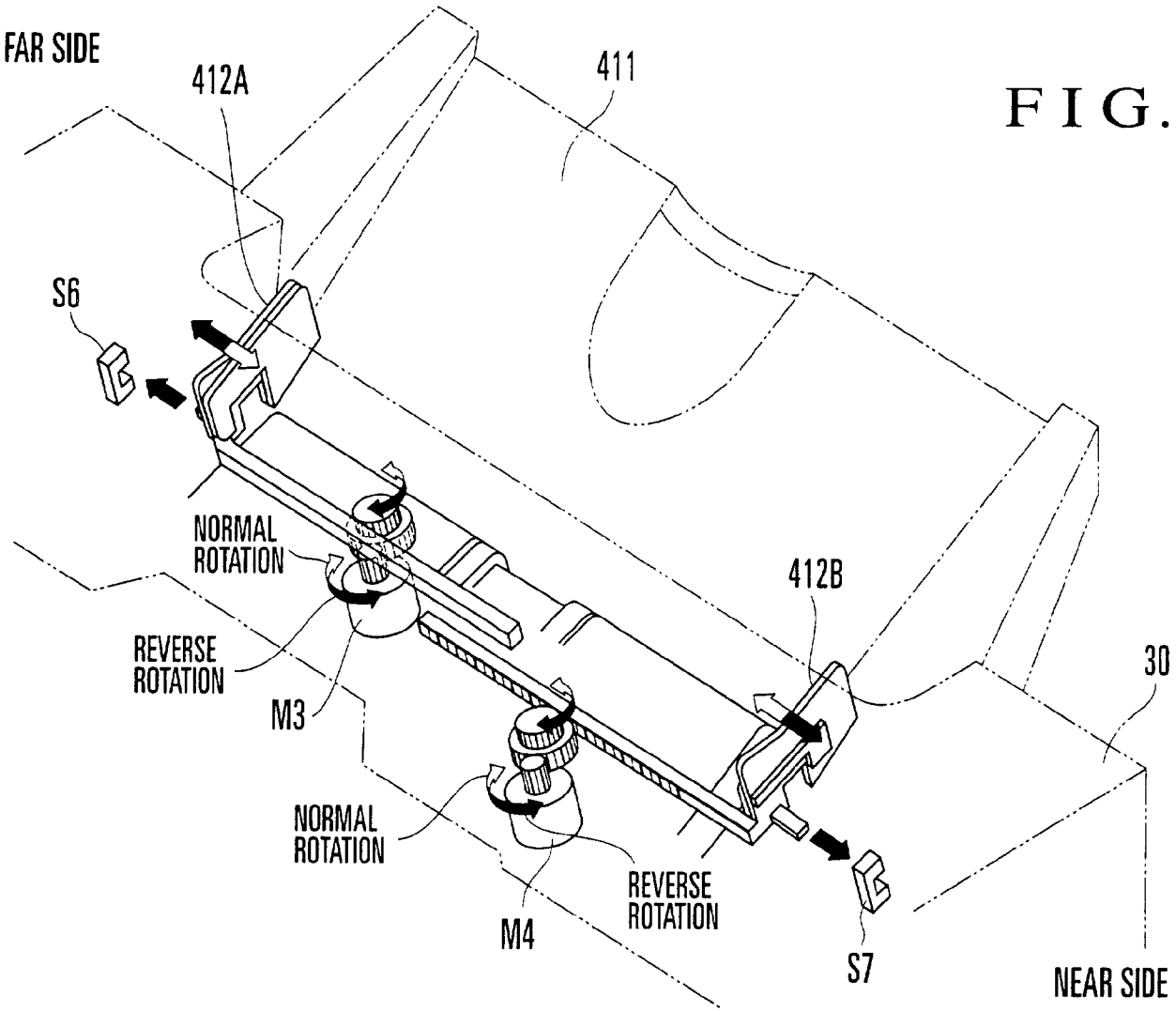
FIG. 7 illustrates the configuration of an aligning plate and a driving mechanism thereof.

The configuration of the aligning plate 412 serving as aligning means in the finisher 400 will now be described. The aligning plate 412 comprises, as shown in FIG. 7, an aligning plate 412A arranged on the depth side of the apparatus main body 30 (hereinafter referred to as the "deep-side aligning plate") and an aligning plate 412B arranged on this side of the apparatus main body 30 (hereinafter referred to as the "this-side aligning plate") provided opposite the each other. The motors M3 and M4 shown in FIG. 7 are aligning plate driving motors which drive the deep-side aligning plate 412A and the this-side aligning plate 412B, respectively. In the finisher 400, when the aligning plate driving motors M3 and M4 rotate forward (clockwise in FIG. 7), the deep-side aligning plate 412A and the this-side aligning plate 412B move closer to each other. When the aligning plate driving motors M3 and M4 rotate in a reverse direction (counterclockwise in FIG. 7), the deep-side aligning plate 412A and the this-side aligning plate 412B move to become more distant from each other.

In the finisher 400, as shown in FIG. 7, home position detecting sensors S6 and S7 are provided to detect the home positions of the deep-side aligning plate 412A and the this-side aligning plate 412B.

In the finisher 400, when applying a staple processing to a sheet bundle on the bundle discharging belt 421 by means of the staple unit 419, control is performed by the finisher control part 401 shown in FIG. 2 by setting the this-side aligning plate 412B at a position closest to this side relative to the apparatus main body 30, and with a view to causing the sheet to collide with the this-side aligning plate 412B in this state, rotation-driving forward the aligning plate driving motor M3 every time a sheet is discharged onto the intermediate processing tray 421X to operate the deep-side aligning plate 412A to move the same toward this side of the apparatus main body 30 so as to press the sheet side surface against the this-side aligning plate 412B.

When carrying out offset discharging by sorting sheet bundles without applying a staple processing, on the other hand, any one of the deep-side aligning plate 412A and the this-side aligning plate 412B is pressed against the sheet every time the sheet is discharged onto the intermediate processing tray 421X so as to cause the sheet to collide with the other of the deep-side aligning plate 412A and the this-side aligning plate 412B in a state in which the deep-side aligning plate 412A and the this-side aligning plate 412B are individually set at distances corresponding to the sheet width.

Figure 18:
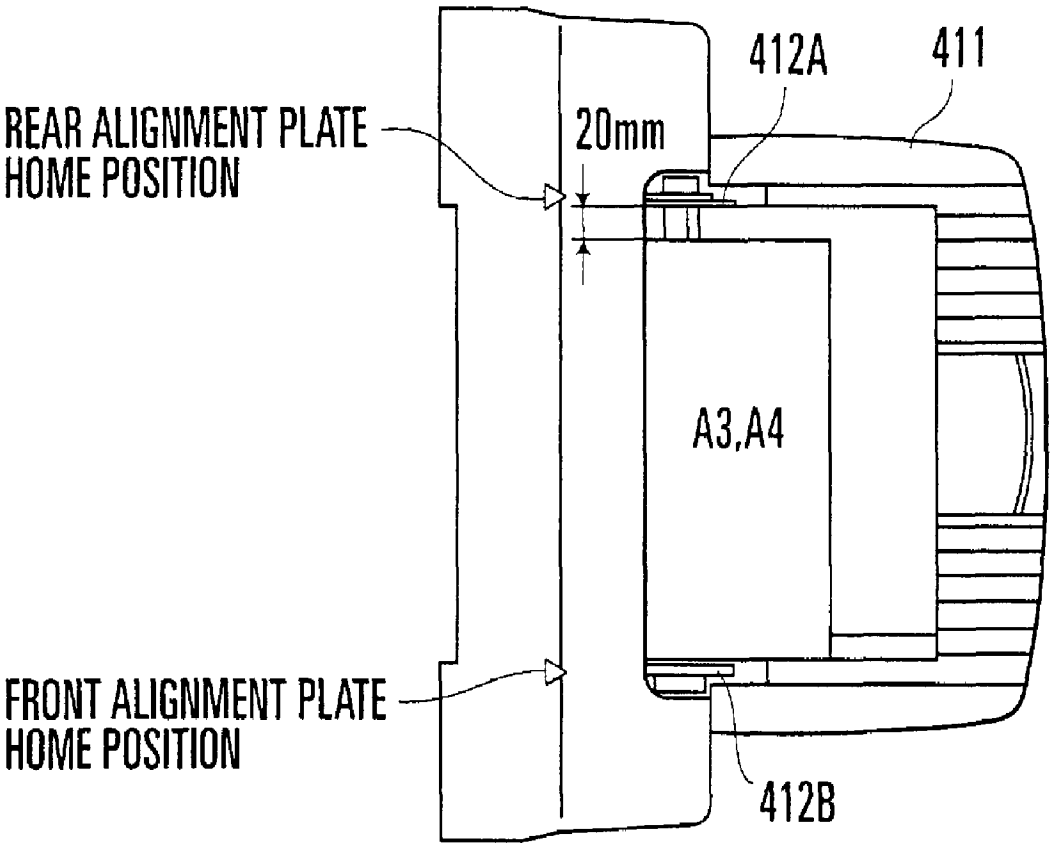
FIG. 18 illustrates the condition of the sheet upon offset discharging in a finisher, and is a plan view for explaining the state in which sheet bundles on the stack tray are shifted from the others.

When conducting offset discharging, each sheet bundle stacked onto the stack tray 411 is in an offset state, as shown in FIG. 18, by alternately shifting the positions of the deep-side aligning plate 412A and the this-side aligning plate 412B (reference positions) to this side, the deep side, this side, deep side. . . . As to whether or not offset discharging is to be carried out, the user can make an appropriate setting by operational input of the above-mentioned operation part 1 shown in FIG. 2. The setting is notified from the copying machine main body 20 to the finisher 400, and the finisher 400 operates in response thereto.

In the present embodiment, as shown in FIG. 1, the finisher 400 is arranged between the image reader 200 and the printer 300. To facilitate removal of sheet bundles discharged onto the stack tray 411 of the finisher 400, control is performed so that the deep-side aligning plate 412A operates to cause at least the first sheet bundle to collide with the this-side aligning plate 412B in a state in which the this-side aligning plate 412B is set at a position closest to this side of the apparatus main body 300.

More specifically, for example, if the absence of a sheet on the stack tray 411 is detected by the sheet presence detecting sensor S11 which detects the presence or absence of a sheet on the stack tray 411 described with reference to FIG. 5, only the deep-side aligning plate 412A is operated with the this-side aligning plate 412B as a reference to align the sheet toward this side. If the presence of a sheet is detected, control is performed by the finisher control part 401 so as to align the first bundle of the next job in a direction opposite to the aligning direction of the sheet bundle stacked in the immediately preceding job.

Figure 23:
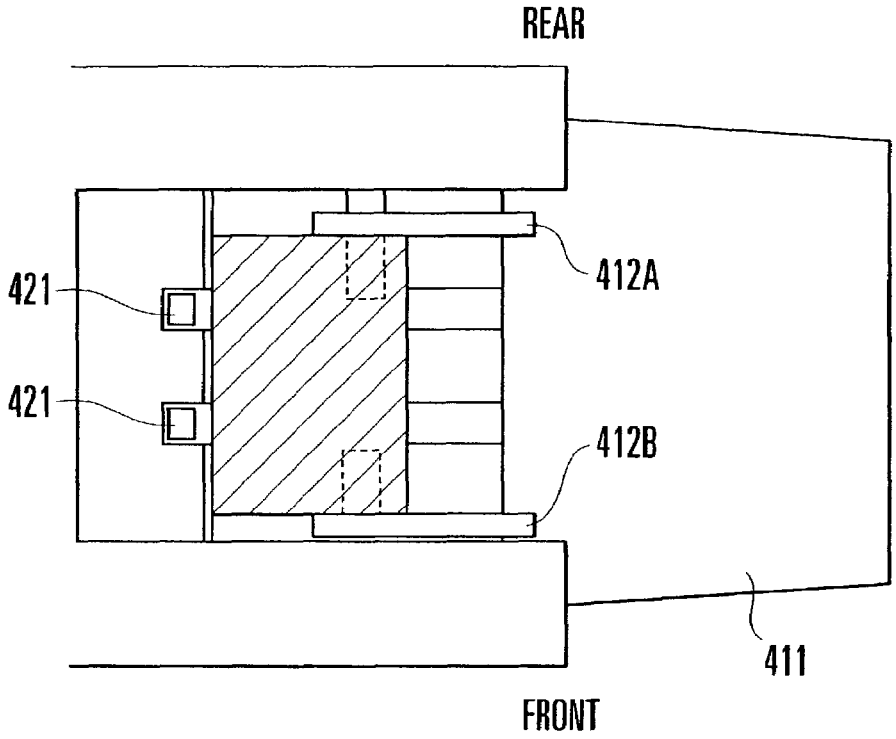
FIG. 23 illustrates alignment of sheets on the intermediate processing tray with only a deep-side aligning plate with the this-side aligning plate as a reference.

In the finisher 400, control is made so as to operate only the deep-side aligning plate 412A, as shown in FIG. 23, to cause the sheet to collide with the this-side aligning plate 412B also for cases other than offset-discharging.

Figure 24:
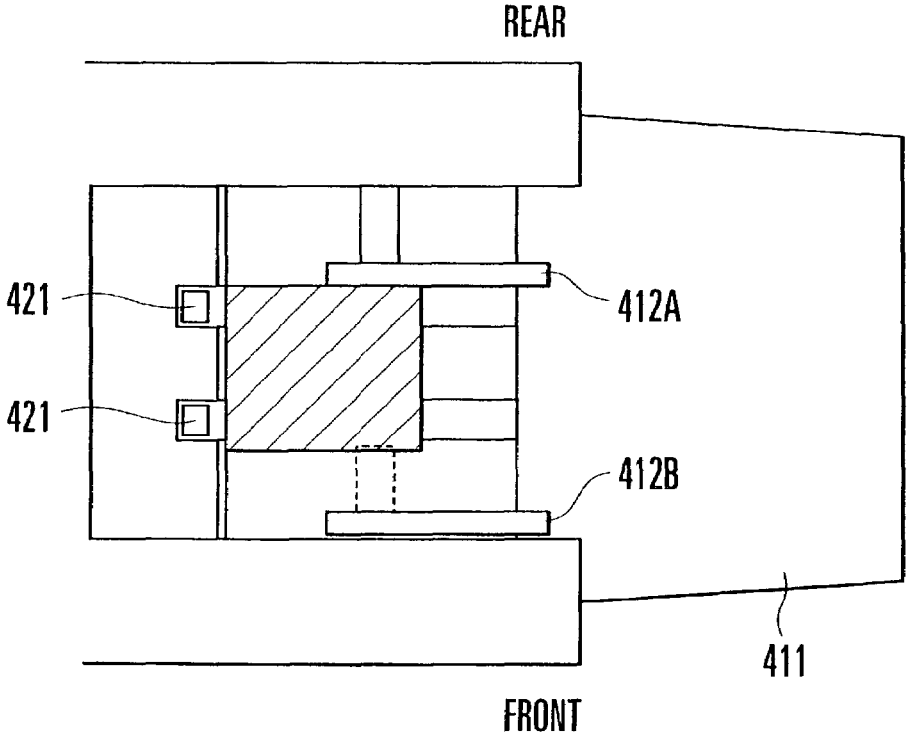
FIG. 24 illustrates aligning operations in a case where the sheet discharged onto the intermediate processing tray has a small width size.

When the sheet size is small as shown in FIG. 24, the sheet bundle does not hit the this-side aligning plate 412B. In the present embodiment, however, the offset discharging meeting the sheet width is achievable by conducting control by means of the finisher control part 401 so that only the rear side deep-side aligning plate 412A moves by a distance corresponding to the sheet width.

When the staple processing is selected by an operational input of the operation part 1, in a configuration in which the staple unit 419 conducting the staple processing is attached to this side of the apparatus main body 30 as in the present embodiment, control is similarly applied by means of the finisher control part 401 so as to operate only the deep-side aligning plate 412A so that the sheet collides with the this-side aligning plate 412B.

The driving timing of the aligning plates 412 and the return roller 417 will be described. In the finisher 400, as described above, the return roller 417 causes the sheet to move in the sheet discharging direction and operates so that the aligning plates 412 cause the sheet to move in a direction perpendicular to the sheet discharging direction. Since the return roller 417 and the aligning plates 412 operate in directions different from each other, overlapping of operations of the both imposes an unnatural force on the sheet, thus exerting an adverse effect. In the present embodiment, therefore, control is performed by the finisher control part 401 so that the aligning plates 412 operate at a timing when the operation of the return roller 417 is completed.

The lifting operation of the stack tray 411 will row be described with reference to FIG. 8. The motor M5 shown in FIG. 8 is a motor arranged to drive the stack tray 411 to cause lifting or lowering thereof (hereinafter referred to as the "stack tray driving motor"). As shown in FIG. 5, an upper limit detecting sensor S13 which detects attainment of an upper limit of the stack tray 411, a lower limit detecting sensor S12 which detects attainment of a lower limit of the stack tray 411, a flag 423 arranged to come into contact with the uppermost surface of the sheet stacked onto the stack tray 411, and a stack tray paper height detecting sensor S10 which detects the height of the uppermost surface of the sheet from the position of the flag 423 are provided in the apparatus main body 30 of the finisher 400.

As shown in FIG. 8, the stack tray 411 is connected to a driving belt 411*b* stretched between a driving shaft 411*a* and a roller 411*c*. When the rotational driving force of the stack tray driving motor M5 is transmitted to the driving shaft 411*a*, the stack tray 411 moves up and down relative to the apparatus main body 30. When the stack tray driving motor M5 rotates forward, the driving belt 411*b* rotates clockwise in FIG. 8, thus causing the stack tray 411 to descend. When the stack tray driving motor M5 rotates backward, the driving belt 411*b* rotates counterclockwise in FIG. 8, thus causing the stack tray 411 to ascend.

As shown in FIG. 8, a flag 411*d* is attached to the driving belt 411*b*. This flag 411*d* is detected by the lower limit detecting sensor S12 and the upper limit detecting sensor S13, thereby permitting detection of the fact that the stack tray 411 has reached the upper limit or the lower limit.

Figure 14:
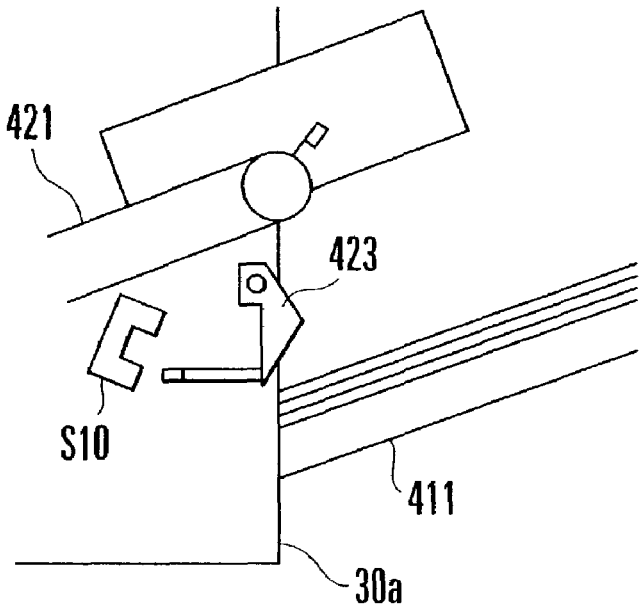
FIG. 14 illustrate the off-state of the stack tray paper height detecting sensor.
Figure 15:
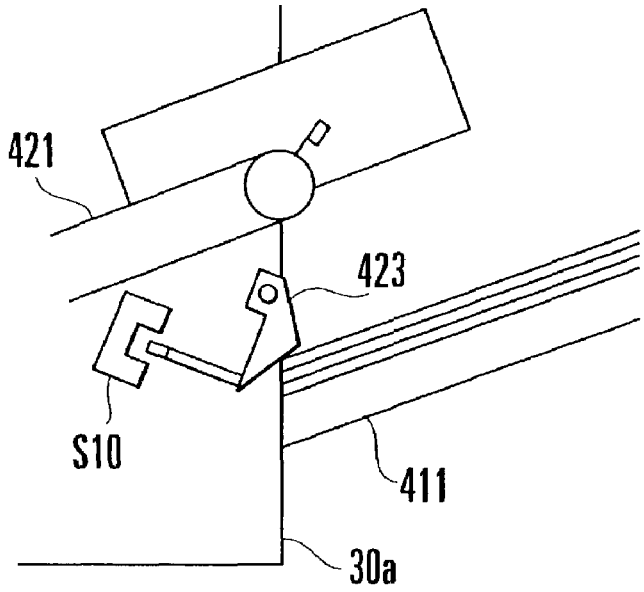
FIG. 15 illustrates the on-state of the stack tray paper height detecting sensor.

The flag 423 is rotatable relative to the apparatus main body 30, and is pushed inside the wall 30*a* of the apparatus main body 30, as shown in FIGS. 14 and 15, as a result of contact with the sheet stacked onto the stack tray 411. Detection of the flag 423 thus pushed in by the stack tray paper height detection sensor S10 permits detection of the height of the upper most surface of the sheets on the stack tray 411.

In the finisher 400, as described above, control is performed by the finisher control part 401 so that the stack tray 411 once descends during discharge of the sheet bundle and the height of the uppermost surface of the sheets on the stack tray 411 becomes lower than the bundle discharging lever 421A, on the basis of the detection signal of the stack tray paper height detecting sensor S10 to prevent the bundle discharging lever 421A shown in FIG. 4 from coming into contact with the sheet on the stack tray 411. More specifically, during descent of the stack tray 411, control is performed so that the stack tray 411 descends to a position where the stack tray paper height detecting sensor S10 becomes non-detective (off).

Figure 6:
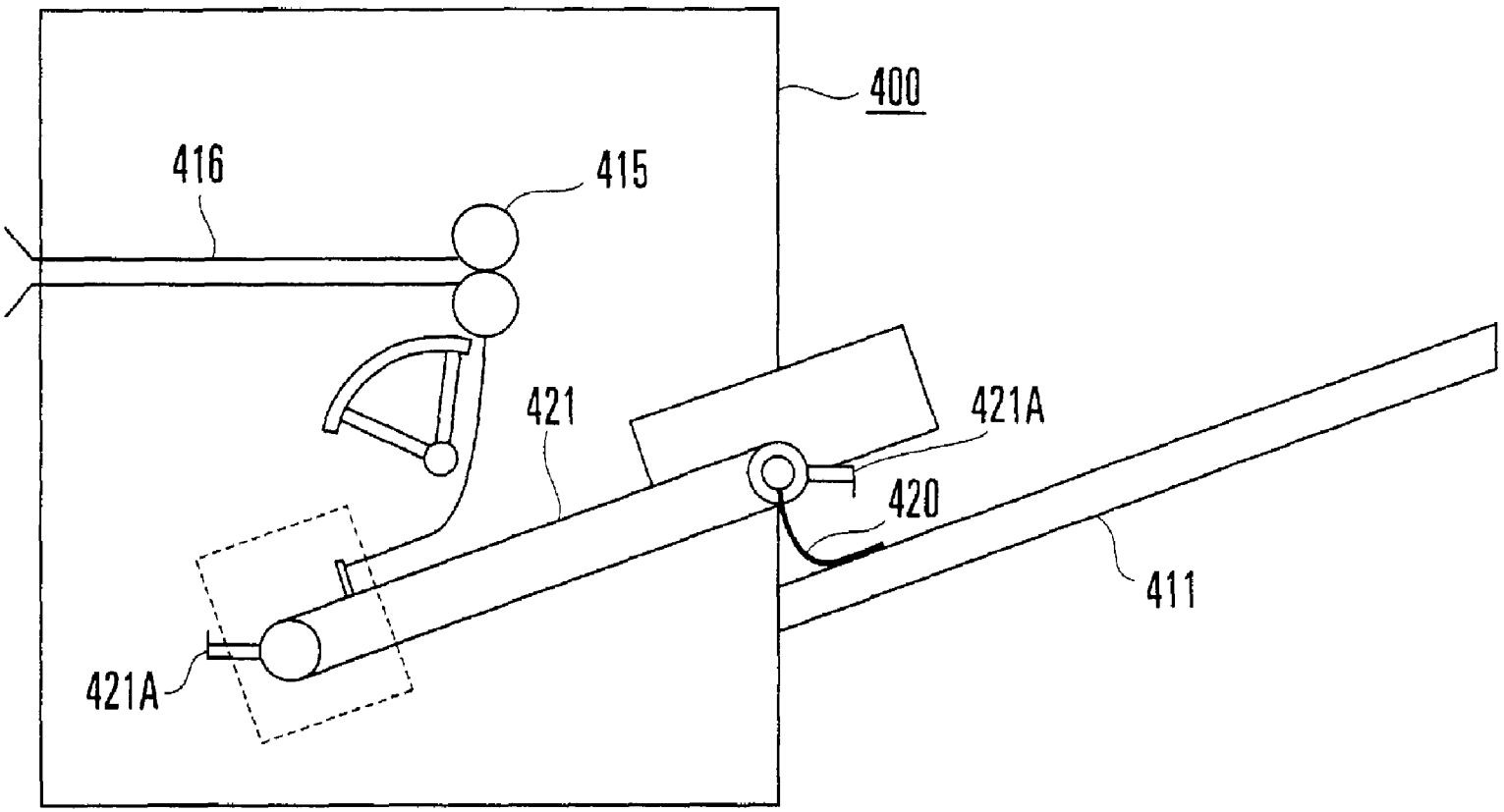
FIG. 6 illustrates the temporary stop position of a bundle discharging lever.

In the finisher 400, after the stack tray 411 once descends, the sheet bundle holding member 420 shown in FIGS. 5 and 6 rotates clockwise in FIGS. 5 and 6 and operates so as to press the sheet bundle on the stack tray 411. Furthermore, to cause the uppermost surface of the sheet bundle stacked on the stack tray 411 to move to the discharging position for the next sheet bundle, control is conducted to raise the stack tray 411.

When designing to make the finisher 400 compact as shown in FIG. 5, the distance between the discharging roller 415 and the sheet passage detecting sensor S2 becomes shorter. When taking account of transferability and stacking convenience of sheets when discharging the sheet by the discharging roller 415 onto the bundle discharging belt 421 (intermediate processing tray), on the other hand, it is desirable to convey the sheet at a high speed by rotating the discharging roller 415 at a high speed at a point in time of starting conveyance of the sheet, and to decelerate the discharging roller 415 at a point when the sheet rear end leaves the discharging roller 415. This permits prevention of the sheet from jumping over the bundle discharging belt 421.

In order to achieve such control, it is the usual practice to adopt a technique of decelerating in response to detection of the sheet rear end. When the distance between the discharging roller 415 and the sheet passage detecting sensor S2 is small as described above, however, even if the sheet can be prevented from jumping over the bundle discharging belt 421, it may sometimes be insufficient for improving stacking convenience. In the present embodiment, therefore, the following control is applied to achieve satisfactory sheet stacking convenience while maintaining a compact finisher.

Figure 9:
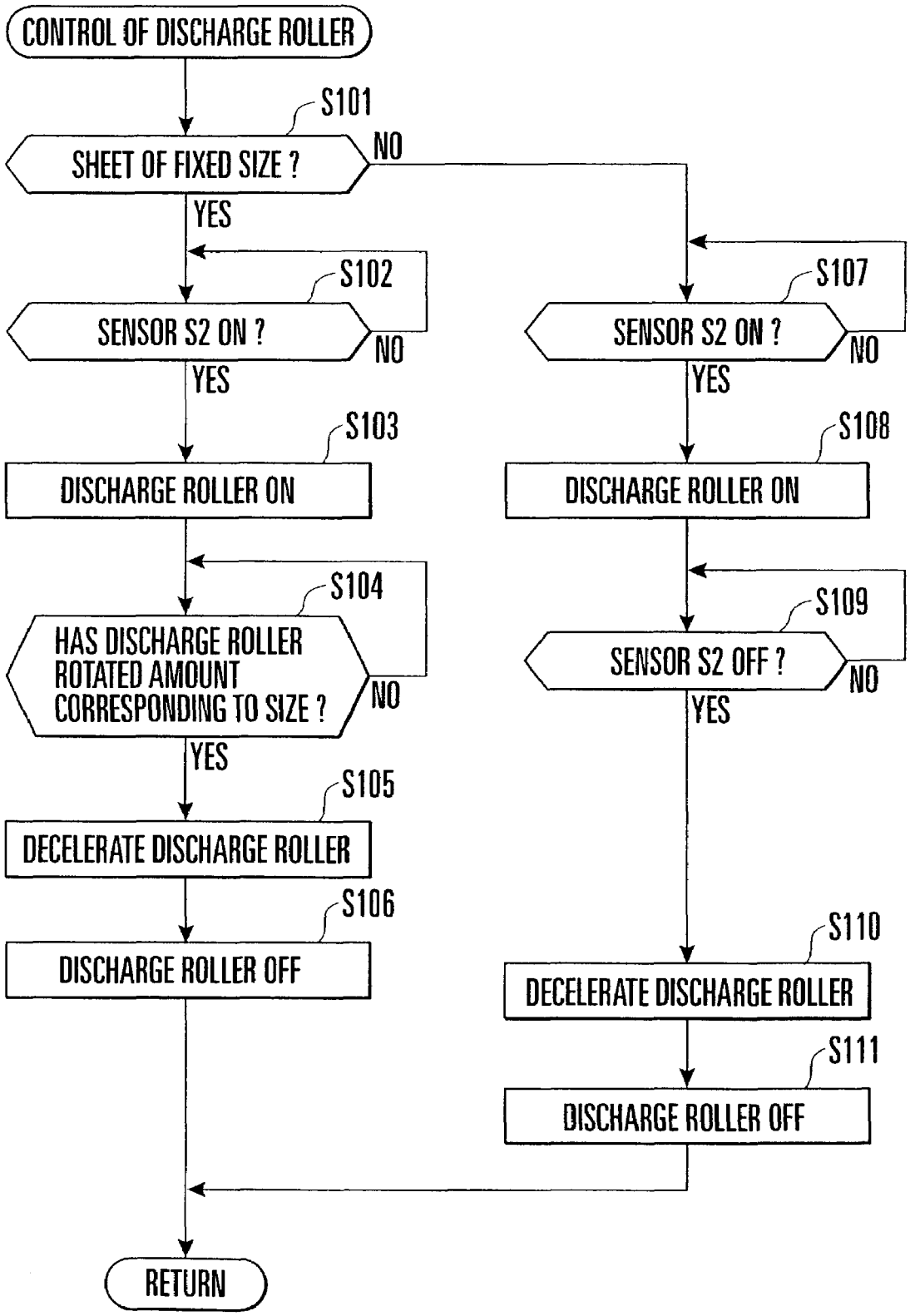
FIG. 9 is a flowchart of drive control of the discharging roller in the finisher.

The driving control of the discharging roller 415 in the finisher 400 will be describe with reference to the flowchart shown in FIG. 9.

The finisher control part 401 of the finisher 400 has previously received size information of the sheet used in the printer 300 from the CPU circuit part 150. First in step S101, it is determined whether or not the sheet to be discharged by the discharging roller 415 has a fixed size. If it has a fixed size, driving of the roller driving motor M1 is started to turn on driving of the discharging roller 415 (step S103) in response to turn-on of the sheet passage detecting sensor S2 (passage of the sheet leading end) (step S102), and it is determined whether or not the discharging roller 415 has rotated by an amount corresponding to the sheet size (step S104). This determination in step S104 can be accomplished by using a step motor as the roller driving motor M1, and always controlling the amount of rotation thereof by the finisher control part 401. Alternatively, this determination may be made by measuring the time from turn-on of the sheet passage detecting sensor S2 and seeing whether or not a prescribed period of time corresponding to the sheet size has elapsed.

When it is determined that the discharging roller 415 has rotated by an amount corresponding to the sheet size in step S104, the finisher control part 401 decelerates the discharging roller 415 (step S105), and stops it (step S106).

When determination in step S104 is based on whether or not a prescribed period of time corresponding to the sheet size has elapsed, this prescribed period of time is set to a value within which the sheet rear end leaves the discharging roller 415 immediately before stoppage thereof in step S106, taking account of the sheet size and the decelerating time of the discharging roller 415. As a result, the discharged sheet never jumps over the bundle discharging belt 421.

When the sheet is determined not to have a fixed size, i.e., to have a free size in step S101, on the other hand, the finisher control part 401 turns on driving of the discharging roller 415 (step S108) in response to turn-on of the sheet passage detecting sensor S2 (passage of the sheet leading end) (step S107). The finisher control part 401 decelerates the discharging roller 415 (step S110) in response to turn-off of the sheet passage detecting sensor S2 (passage of the sheet rear end) (step S109), and stops the discharging roller 415 (step S111).

When the distance between the sheet passage detecting sensor S2 and the discharging roller 415 is relatively small as shown in FIG. 5, the sheet rear end leaves the discharging roller 415 before sufficient deceleration in step S110. Even in this case, the sheet never jumps over the bundle discharging belt 421, but reliability as to stacking convenience becomes doubtful.

To avoid this problem, it is conceivable to arrange the sheet passage detecting sensor S2 more in the upstream of the path 416. While this would improve stacking convenience, this configuration poses a new problem in that, when the sheets form a jam at the discharging roller 415, this makes it impossible for the sheet passage detecting sensor S2 to detect the jam.

Another conceivable solution is to adopt a configuration in which the position of the sheet passage detecting sensor S2 is left as it is, and another sensor is added in the further upstream in the path 416. This results in a higher cost. It is furthermore conceivable to solve the aforementioned problem by reducing the distance necessary for deceleration by increasing the torque of the roller driving motor M1. This solution also requires a higher cost.

To solve the problem, in the present embodiment, only one sheet passage detecting sensor S2 is provided in the path 416 at the position shown in FIG. 5 and a control as shown in FIG. 9 is conducted, thereby coping with fixed-size sheets, with a view to improving sheet transferability and stacking convenience as far as possible while maintaining the low cost. When discharging a non-fixed size sheet in step S107 and subsequent steps, it is desirable to use a lower rotational speed of the roller driving motor M1 than in the case of a fixed size.

Figure 10:
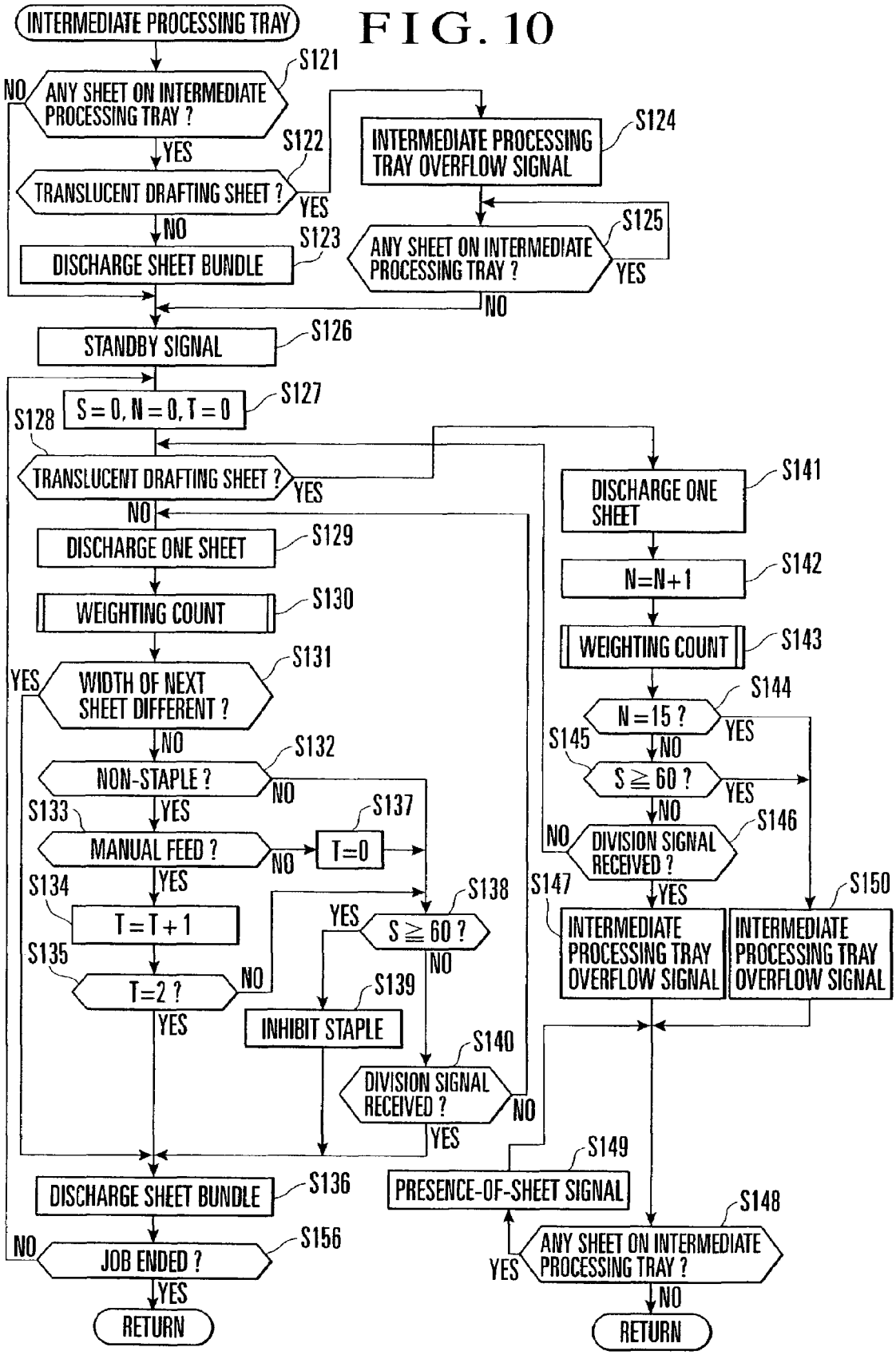
FIG. 10 is a flowchart of control of the intermediate processing tray, particularly including control of bundle discharge by the bundle discharging belt.

The control applied by the finisher control part 401 when carrying out a post-processing for a sheet bundle stacked on the intermediate processing tray 421X will now be described with reference to the flowchart shown in FIG. 10.

When a translucent drafting sheet is mounted on the intermediate processing tray, the finisher 400 in the present embodiment performs processing for removing the same by the user. More specifically, the translucent drafting sheet is a thin and soft sheet used for drafting, and an image can be formed on the translucent drafting sheet by feeding the translucent drafting sheet from the manual feeding part 125 of the printer 300. However, because the translucent drafting sheet is soft and is not suitable for bundle discharging, bundle discharging is not carried out and the user should remove the translucent drafting sheet from the intermediate processing tray. An intermediate processing tray overflow signal is used as a signal for starting display of urging this operation on the printer 300 side.

The finisher control part 401 of the finisher 400 first determines whether or not there is a sheet on the intermediate processing tray 421X in the initial state before the image forming operation by the printer 300, on the basis of an output signal of the sheet presence detecting sensor S5 (step S121).

If the presence of a sheet is determined, the process proceeds to step S122, and it is determined whether or not the sheet is a translucent drafting sheet. If the absence of a sheet is determined, on the other hand, a standby signal is issued to the printer control part 301 of the printer 300 in step S126.

Figure 11A:
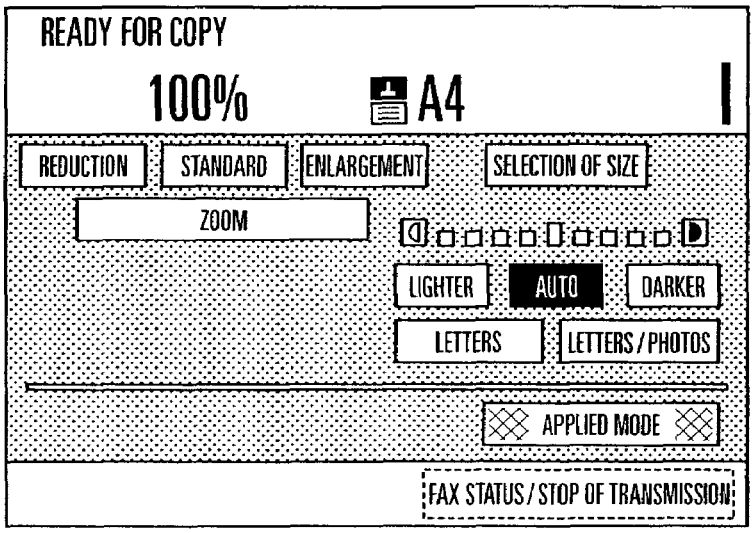
FIGS. 11(*a*), 11(*b*), and 11(*c*) illustrate screens for setting a material in the image forming apparatus.
Figure 11B:
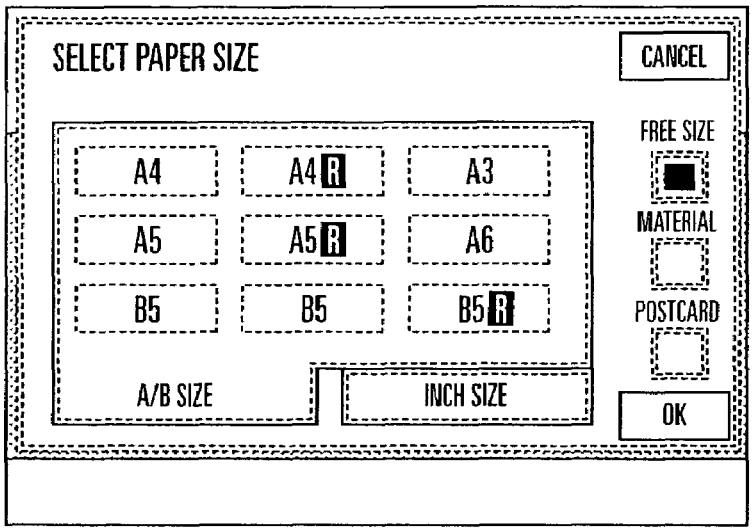
Figure 11C:
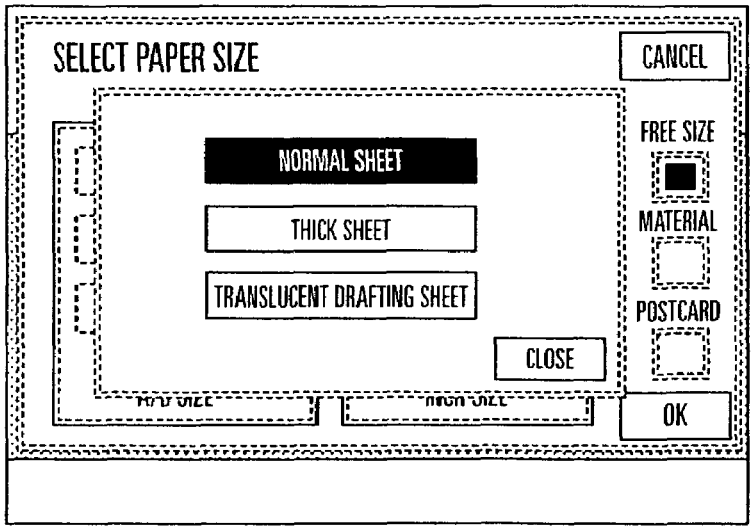

The method of determining whether or not the sheet is a translucent drafting sheet will be described. When the use of the manual feeding part 125 shown in FIG. 1 is set on the printer 300 side, the screen of the display panel of the operation part 1 arranged above the copying machine main body 20 comes into the state shown in FIG. 11(*b*), and the pressing of the material key on the screen results in the state shown in FIG. 11(*c*). When the translucent drafting sheet key is pressed in this screen, the translucent drafting sheet is deemed to be fed from the manual feeding part 125. Upon passing the sheet from the printer 300 to the finisher 400, sheet material information and paper feed information correlated with the sheet size information are notified from the printer control part 301 to the finisher control part 401. That is, the use of the translucent drafting sheet as the sheet material information is notified, and the use of the manual feeding part 125 as paper feed information is notified to the finisher control part 401. Thus, the finisher control part 401 can determine whether or not the sheet on the intermediate processing tray 421X (having an image formed thereon) is a translucent drafting sheet by confirming the sheet material information notified from the printer control part 301. FIG. 11(*a*) illustrates the screen of the display panel of the operation part 1 during the usual standby in the copying mode, and copying magnifications, a paper size and a number of copied sheets set by the operation part 1 are displayed.

When the sheet is determined to be a translucent drafting sheet in step S122, the finisher control part 401 issues in step S122 an intermediate processing tray overflow signal to the printer control part 301 of the printer 300. Upon receipt of the intermediate processing tray overflow signal, the printer control part 301 controls the operation part 1 to display a message "Remove sheet on intermediate processing tray" on the operating panel. In the next step S125, the finisher control part 401 monitors an output signal of the sheet presence detecting sensor S5, and waits for exhaustion of sheets from the intermediate processing tray 421X. Then, the process proceeds to step S126 when there is no sheet, and the finisher control part 401 issues a standby signal to the printer control part 301 of the printer 300.

When the sheet is determined not to be a translucent drafting sheet in step S122, the finisher control part 401 discharges the sheet bundle on the bundle discharging belt 421 by drive-controlling the bundle discharging belt 421 (step S123), and issues a standby signal to the printer control part 301 of the printer 300 (step S126).

Upon receipt of the standby signal, the printer control part 301 of the printer 300 starts sheet feeding from a prescribed sheet feeding part, and performs control so as to start image forming onto the fed sheet.

After the standby signal in step S126, the finisher control part 401 sets variables S, N and T stored in a work area (not shown) to "0" (step S127). The variables S and N are for carrying out monitoring so as to avoid overstacking onto the intermediate processing tray 421X. The variable T is, on the other hand, a variable for preventing static electricity generated on an OHP sheet from exerting an adverse effect on the other sheets on the stack tray 411.

In the next step S128, the finisher control part 401 determines whether or not the sheet discharged from the printer 300 is a translucent drafting sheet, on the basis of the sheet material information sent from the printer control part 301 of the printer 300.

When the sheet is determined not be a translucent drafting sheet in step S128, the finisher control part 401 performs the following processes. The finisher control part 401 carries out control so as to discharge the sheet received from the printer 300 onto the intermediate processing tray 421X (step S129), and performs weighting count for the variable S (step S130). The finisher control part 401 receives size information of the sheet to be discharged next from the printer 300 from the printer control part 301, and determines whether or not the sheet stacked already on the bundle discharging belt 421 is different in width from the sheet to be discharged next from the printer 300 (step S131).

In the case of "No", i.e., when these sheets have the same width, the process proceeds to step S132, and it is determined whether or not the current setting of the image forming job to the sheet being currently received is in the non-staple mode (not conducting the staple processing). In the case of "Yes", i.e., when in the non-staple mode, the process proceeds to step S133 to determine whether or not the sheet discharged onto the bundle discharging belt 421 in step S129 is the one fed from the manual feeding part 125.

The manual feeding part 125 has a configuration permitting feeding of various kinds of sheet including an OHP sheet. The OHP sheet tends to easily have static electricity as compared with ordinary sheets of paper. Therefore, even when 30 sheets of ordinary paper are bundle-discharged at a time from the bundle discharging belt 421 onto the stack tray 411 and exert no adverse effect on the sheets on the stack tray 411, the bundle-discharging of 30 OHP sheets at a time onto the stack tray 411 may cause shifting of the sheets on the stack tray 411 under a synergetic effect of weight and static electricity.

In the present embodiment, therefore, shifting of the sheets on the stack tray 411 is prevented, when two sheets are fed in succession from the manual feeding part 125 through which OHP sheets can be fed, by conducting bundle-discharging onto the stack tray 411.

More specifically, when the sheet is determined to be the one fed from the manual feeding part 125 in step S133, the finisher control part 401, in step S134, adds "1" to the variable T, and determines whether or not the variable T has become "2" in the next step S135. When it is determined that the variable T has become "2", this represents a case where two sheets are fed in succession from the manual feeding part 125. In this case, the bundle discharging belt 421 is driven to discharge the sheet bundle in step S136. In the next step S156, it is determined whether or not the job is completed. If completed, the series of processes comes to an end, and if not completed, the process returns to step S127.

When the sheet is determined not to be the one fed from the manual feeding part 125 in step S133, the finisher control part 401 sets the variable T to "0" by considering that there is no risk of feeding OHP sheets (step S137), and the process proceeds to step S138 described later. When the variable T has not become "2" in step S135, as well, the process proceeds to step S138.

When it is determined that the sheet stacked onto the bundle discharging belt 421 is different in width from the sheet received next in step S131, the procedure proceeds to step S136, where the finisher control part 401 discharges the sheet bundle onto the stack tray 411.

When it is determined not to be in the non-staple mode, i.e., when it is determined to be in the staple mode, in step S132, the procedure proceeds to step S138, where the finisher control part 401 determines whether or not the variable S has become at least "60". If it is determined that the variable S is not at least "60", i.e., under "60", the procedure proceeds to step S140, where the finisher control part 401 determines whether or not a pause between jobs is present on the basis of a signal representing a division between jobs (job division signal) transmitted from the printer control part 301 of the printer 300 for each job. If it is a division between jobs, the process proceeds to step S136, where the sheet bundle is discharged onto the stack tray 411.

When the variable S is determined to be at least "60" in step S138, the current staple is disabled (step S139), and the process proceeds to step 136 to discharge the sheet bundle onto the stack tray 411. Disabling staple is released after receiving a job division signal from the printer control part 301.

When the sheet is determined to be a translucent drafting sheet in step S128, the finisher control part 401 discharges the sheet received from the printer 300 onto the bundle discharging belt 421 (step S141), and adds "1" to the variable N (step S142). The finisher control part 401 conducts weighting count to the variable S (step S143), and determines whether or not the variable N has become "15" (step S144). When the variable N has not become "15", it is determined whether or not the variable S has become at least "60" (step S145). When the variable S has not become at least "60", it is determined whether or not it is a division between jobs, on the basis of the job division signal from the printer control part 301 (step S146). If it is not a job division, the finisher control part 401 returns to step S128. If it is a division between jobs, on the other hand, an intermediate processing tray overflow signal is issued to the printer control part 301 (step S147), and the printer 300 gives a display to remove the sheet on the intermediate processing tray 421X.

In step S148 following the step S147, the finisher control part 401 determines the presence or absence of a sheet on the bundle discharging belt 421 (intermediate processing tray) from the output signal of the sheet presence detecting sensor S5, and issues an intermediate processing tray sheet presence signal to the printer 300 until removal of the sheet from the intermediate processing tray 421X (step S149). While receiving the intermediate processing tray overflow signal and receiving the intermediate processing tray sheet presence signal, the printer control part 301 does not start the next image forming job.

When the variable N becomes "15" in step S144, or when the variable S becomes at least "60" in step S145, the finisher control part 401 recognizes that the limit amount of stacking for the intermediate processing tray 421X has been reached, and issues an intermediate processing tray overflow signal (step S150), then proceeding to step S148. In this case also, the printer control part 301 controls the operation part 1 so as to make a display for instructing removal of the sheet on the intermediate processing tray 421X on the screen of the display panel.

Figure 20:
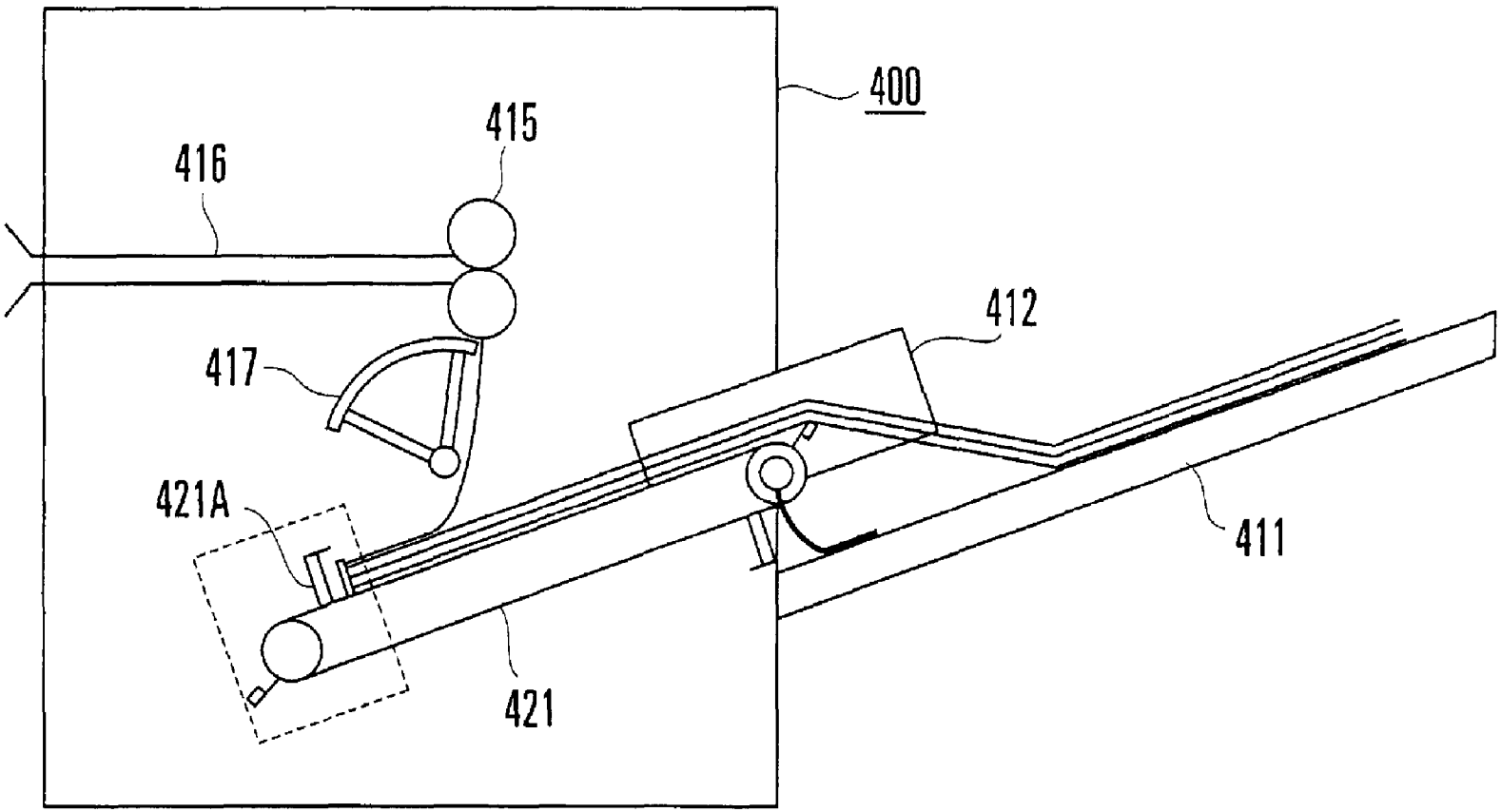
FIG. 20 illustrates the state upon discharging a translucent drafting sheet onto the intermediate processing tray in a finisher.

When the process proceeds to a processing in step S129 and the subsequent steps (in the case of a sheet other than the translucent drafting sheet), the finisher control part 401 causes the aligning plates 412 to perform the aligning operation in response to the sheet size and rotates the return roller 417. When the process proceeds to a processing subsequent to step S141 (in the case of the translucent drafting sheet), the finisher control part 401 causes the aligning plates 412 to be in standby at a position not disturbing the sheet stacking to prohibit the aligning operation, and does not drive the return roller 417. The condition on the bundle discharging belt 421 upon discharging the translucent drafting sheet is illustrated in FIG. 20.

Figure 12:
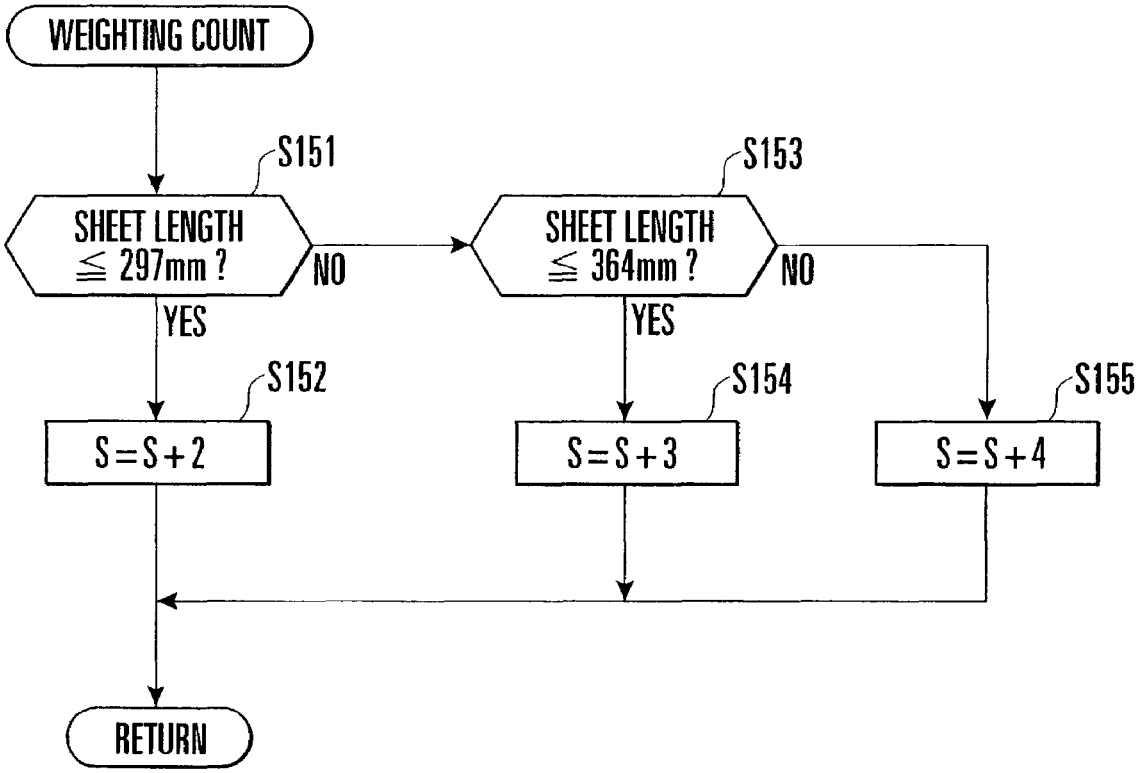
FIG. 12 is a flowchart of weighting count in steps S130 and S143 shown in FIG. 10.

FIG. 12 is a flowchart of the weighting count in steps S130 and S143. The finisher control part 401 adds "2" to the variable S (step S152) when the sheet length (length in the conveying direction) is not longer than 297 mm (step S151) on the basis of the size information for each sheet received from the printer control part 301 of the printer 300. When the sheet length is longer than 297 mm and not longer than 364 mm, "3" is added to the variable S (step S154). When the sheet length is longer than 364 mm, "4" is added to the variable S (step S155). By performing the weighting count to the count value in response to the sheet length as described above, it is possible to stack bundles in a number suitable for bundle discharging when carrying out bundle discharging, and when bundle discharging is not conducted, stacking is possible to an extent not causing scattering of sheets on the intermediate processing tray 421X.

Control upon lifting or lowering the stack tray 411 will now be described with reference to the flowchart shown in FIG. 13.

Figure 13:
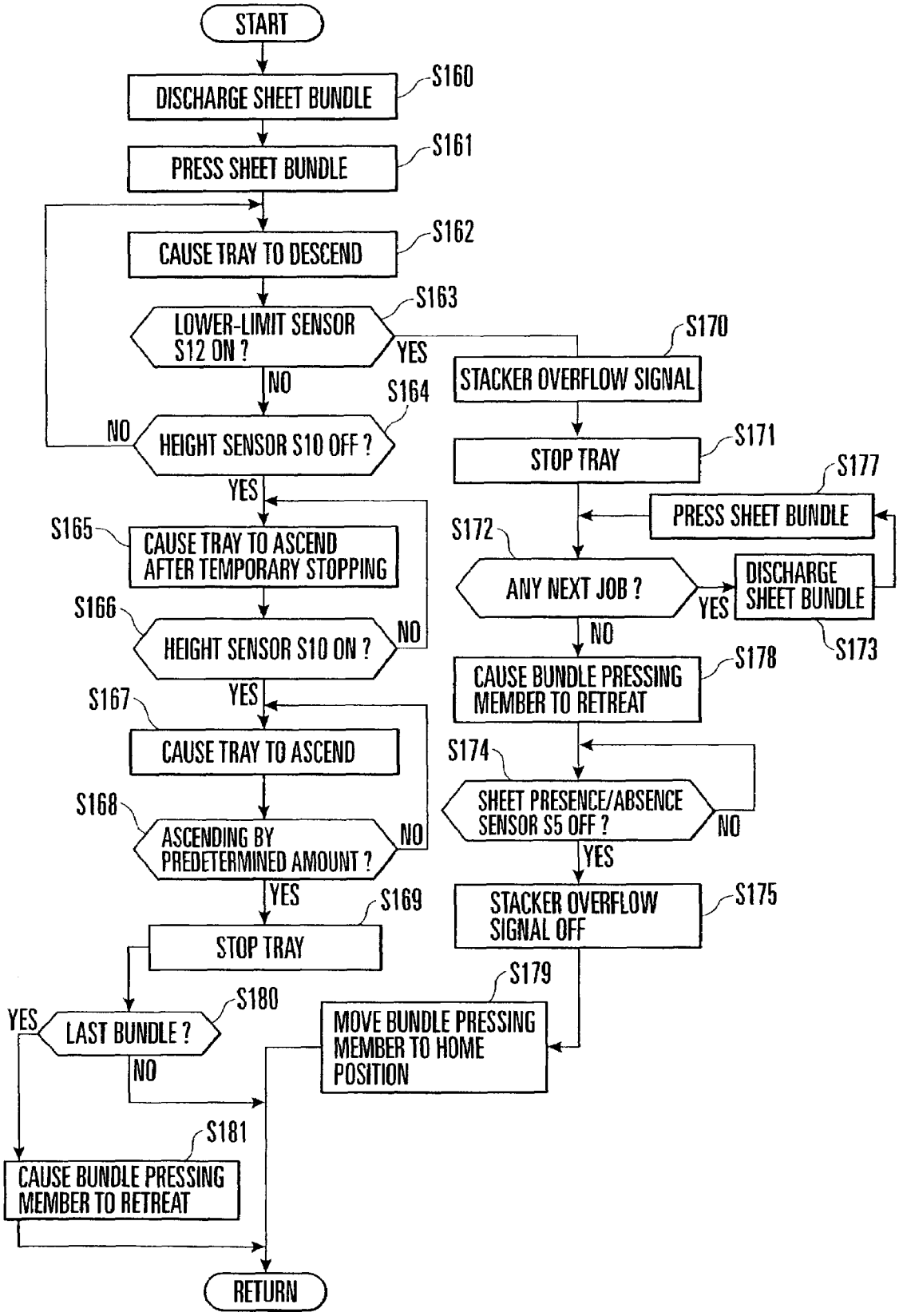
FIG. 13 is a control flowchart upon lifting or lowering the stack tray in the finisher.

FIG. 13 is a control flowchart of the stack tray 411 carried out by the finisher control part 401. Prior to starting copying, lifting and lowering of the stack tray 411 are controlled by the finisher control part 401 so that the stack tray paper height detecting sensor S10 is turned on.

In step S160 after start of copying, the finisher control part 401 discharges the sheet bundle by driving the bundle discharging belt 421 through the forward rotation of the intermediate tray driving motor M2 for the sheets received from the printer 300. In the next step S161, a series of control operations are carried out for the sheet bundle discharge of pressing the sheet bundle on the stack tray 411 by rotating the sheet bundle holding member 420 through the reverse rotation of the intermediate tray driving motor M2. Then, the tray driving motor M5 is drive-controlled to start the descent of the stack tray 411 (step S162). The finisher control part 401 monitors output signals of the lower limit detecting sensor (see FIG. 8) and the stack tray paper height detecting sensor S10 (steps S163 and S164) to determine whether or not the stack tray paper height detecting sensor S10 has been turned on, i.e., whether or not the lower limit of the stack tray 411 has been reached, and whether or not the stack tray paper height detecting sensor S10 is turned off.

When the lower limit sensor S12 is turned off and the stack tray paper height detecting sensor S10 is turned on, the process returns to step S162 to continue the descent of the tray. When the stack tray paper height detecting sensor S10 is turned off before the lower limit sensor S12 is turned on, the stack tray 411 has a room in the stacking capacity. In this case, step S165 and subsequent steps described later are executed.

When the stack tray paper height detecting sensor S10 is turned on before the lower limit detecting sensor S12 is turned off, on the other hand, this is deemed to suggest that the stacking capacity has been reached for the stack tray 411, and the step S170 and the subsequent steps are executed.

The finisher control part 401 once stops the stack tray 411 in step S165, and drive-controls the tray driving motor M5 so as to cause the stack tray 411 to start ascension after the lapse of a prescribed period of time. In the next step S166, an output signal of the stack tray paper height detecting sensor S10 is monitored. When the stack tray paper height detecting sensor S10 is turned on, the stack tray 411 is caused to continue ascending for a prescribed amount of ascension (steps S167 and S168), and to stop when the stack tray has ascended by a prescribed amount from turn-on of the stack tray paper height detecting sensor S10 (step S169).

In the present embodiment, the stack tray driving motor M5 causing up-down movement of the stack tray 411 comprises a DC motor. The amount of movement of the stack tray 411 can, therefore, be monitored by the finisher control part 401 by entering a number of pulses from an encoder provided on the DC motor shaft. The stack tray driving motor M5 may comprise a stepping motor, and monitoring may be accomplished by counting the number of impact clocks by means of the finisher control part 401.

When the lower limit detecting sensor S12 is turned on, i.e., when the lower limit has been reached by the stack tray 411, a stacker overflow signal is issued to the printer control part 301 of the printer 300 (step S170) to discontinue the operation of the stack tray 411 (step S171). Upon receipt of this stacker overflow signal, the printer control part 301 conducts control so as to cause a display of a message "Remove sheet on stack tray" on the display panel of the operation part 1 after the completion of the job.

The finisher control part 401 determines whether or not there is the next job for bundle discharge (step S172). If there is the next job, the finisher control part 401 conducts control for sheet bundle discharge (step S173) and control for pressing the sheet bundle (step S177). Control performed in steps S173 and S177 is the same as the above-mentioned control in steps S160 and S161.

If there is no next job for bundle discharge, on the other hand, the finisher control part 401 conducts control so as to cause the sheet bundle holding member 420 to retreat in step S178, thereby facilitating removal of the sheet bundle by the user. It is in standby until the sheet presence detecting sensor S5 is turned off in the next step S174 (step S174). When the sheet presence detecting sensor S5 is turned off, this is interpreted to mean removal of the sheet on the stack tray 411. Then, the stacker overflow signal issued to the printer control part 301 is turned off (step S175), and the intermediate processing tray driving motor M2 is drive-controlled so as to bring the sheet bundle holding member 420 back to the home position thereof.

In the present embodiment, as described above, when the lower limit of the stack tray 411 is reached during the descent of the stack tray 411, the bundle discharging operation is carried out of some bundles corresponding to jobs which cannot be discontinued already at the point in time when the lower limit was detected (for example, jobs received from the computer 204) without conducting the ascending operation of step S165 or S167, by executing steps S170 to S179.

Figure 21:
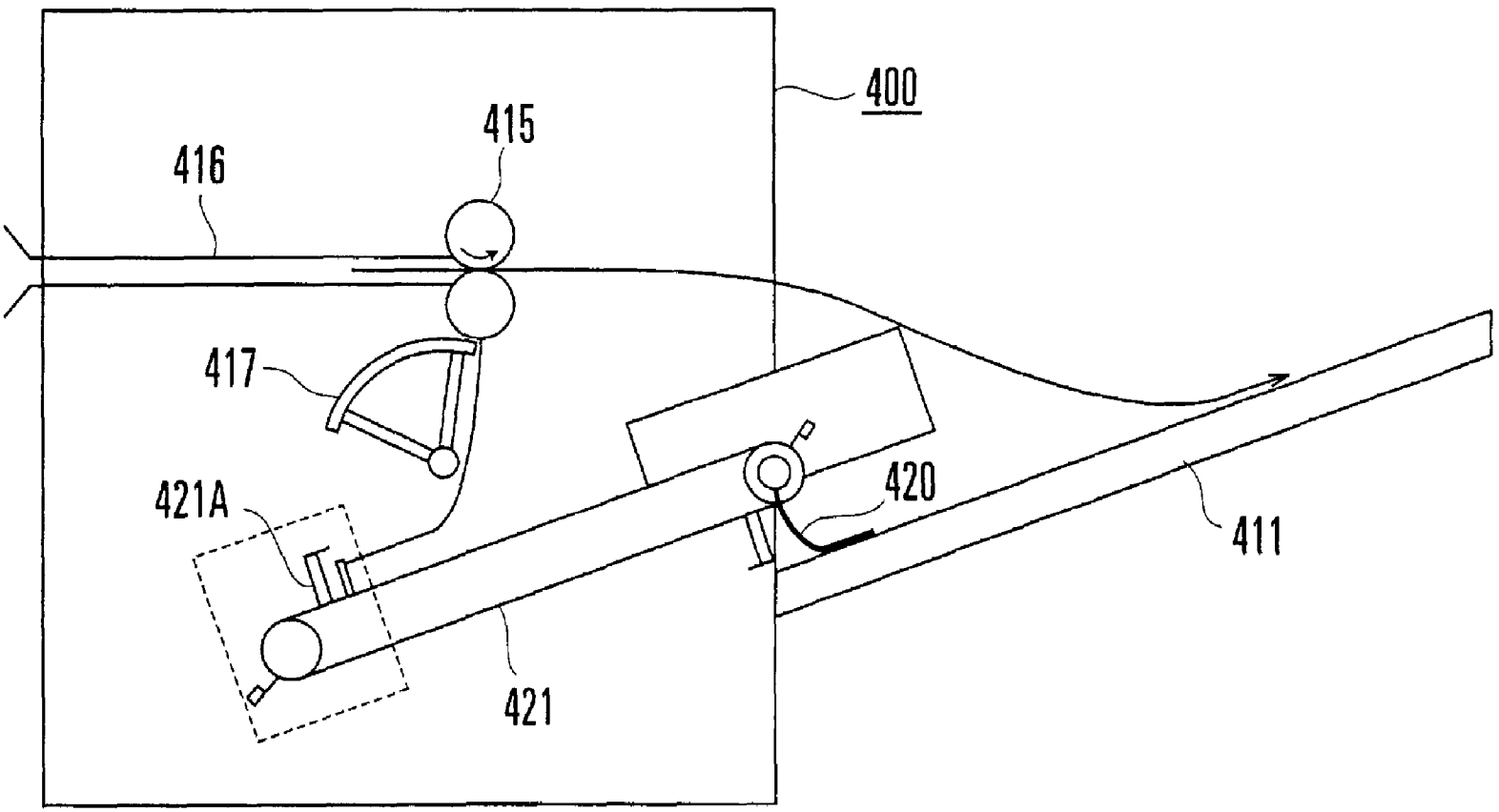
FIG. 21 illustrates the locus of the sheet leading end upon discharging the translucent drafting sheet onto the intermediate processing tray by the conveyance roller.

The height position of the stack tray 411 suitable for bundle discharging will be described. If the bundle discharging belt 421 is excessively spaced apart from the stacking surface of the stack tray 411, the sheet bundle on the stack tray 411 has a poor stacking convenience. Since the leading end of the sheet during discharge onto the discharging roller 415 follows a locus as shown in FIG. 21, with a short distance, the sheet leading end collides with the slant portion of the stacking surface of the stack tray 411, and this may lead to the occurrence of a jam during conveyance of the discharging roller 415. Therefore, the distance between the bundle discharging belt 421 and the stacking surface of the stack tray 411 is adjusted to a distance which leads to a low susceptibility to jam and to a satisfactory stacking convenience through control of up and down movements in steps S162 to S169.

In the present embodiment, the upper surface of the sheet on the stack tray 411 is detected by means of the stack tray paper height detecting sensor S10. Therefore, if the sheet upper surface cannot be detected during the descent of the stack tray 411, it would be impossible to accurately control the distance between the bundle discharging belt 421 and the stacking surface of the stack tray 411. Control may be done by estimating the bundle thickness from the number of bundle-discharged sheets. However, the sheet thickness is variable, and an actual bundle thickness may be different from the estimated value. If a bundle thicker than the estimated value is discharged onto the stack tray 411, the distance between the bundle discharging belt 421 and the stacking surface of the stack tray 411 would become smaller, thus producing a possibility of occurrence of jam.

In the present embodiment, under these circumstances, when the lower limit of the stack tray 411 is reached during the descending operation of the stack tray 411, the remaining sheet bundles are discharged without conducting the ascending operation of the stack tray 411 through control of steps S170 to S173 and step S177.

As a result, the distance between the bundle discharging belt 421 and the stacking surface of the stack tray 411 becomes slightly larger, and the stacking convenience may become poorer on the stack tray 411. It is, however, possible to prevent the occurrence of jam, and in addition, because the sheet bundle discharged at this point in time is the one toward the end, a slightly lower stacking convenience does not exert a serious effect.

Figure 22:
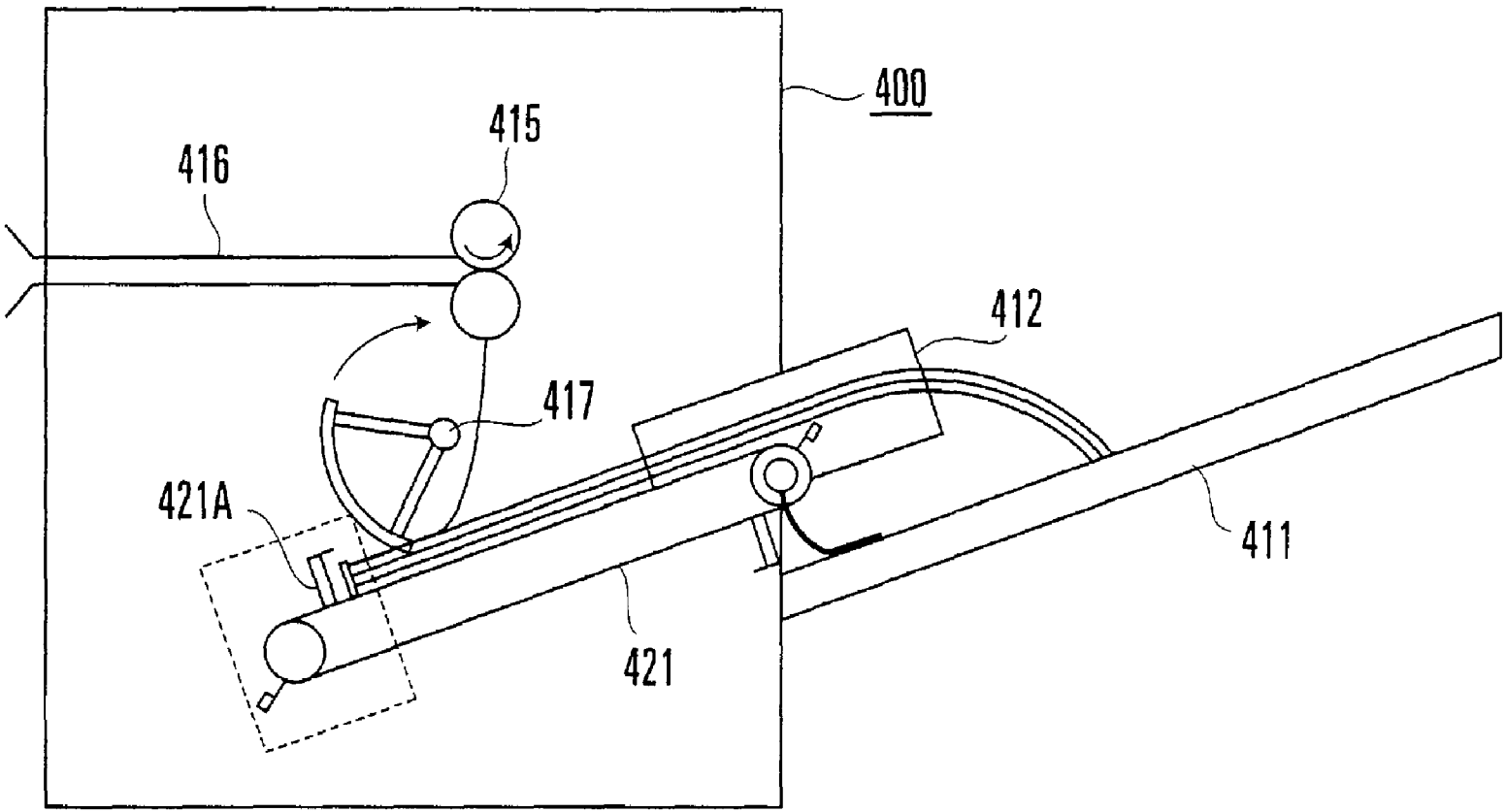
FIG. 22 illustrates the condition of a sheet in the finisher for explaining the state in which a sheet long in the conveying direction is discharged onto the intermediate processing tray.

In the present embodiment, in order to achieve a compact and low-cost finisher 400, the bundle discharging belt 421 is made slightly shorter. When handling A4R-size or A3-size sheets long in the conveying direction, the portion not covered by the bundle discharging belt 421 is supported on the stack tray 411, as shown in FIG. 22.

When the stacking of sheets on the stack tray 411 is detected by the sheet presence detecting sensor S11 at the time of starting an image forming job in the staple mode of the printer 300, the printer control part 301 of the printer 300 controls the operation part 1 so as to display a message "Remove sheet from stack tray" on the screen of the display panel. Because the stacking of staple-processed sheet bundles onto the stack tray 411 causes overlapping of staple portions, thus leading to a lower stacking convenience, it is desired to start an image forming job in a state in which no sheet is stacked on the stack tray 411 as far as possible. However, since the printer 300 can be used not only in the copy mode but also in the printer mode, control is performed so that an image forming job (including the staple processing and the bundle discharge) can be started even without removing sheets, taking account of the absence of the user near the machine in the printer mode.

Upon completion of an image forming job of printing 30 copies in succession in the staple mode of the printer 300, the image forming job is once interrupted, a message "Remove sheet from stack tray" is displayed on the screen of the display panel of the operation part 1, and the resumption of the image forming job is refrained until the sheets are removed from the tack tray 411 and the sheet presence detecting sensor S11 is turned off.

According to the copying machine 10 of the present embodiment, as described above, at least the first bundle of the sheet groups conveyed by the discharging roller 415 of the finisher 400 is controlled by the aligning plates 412 serving as aligning means so as to be aligned at a position closest to this side of the apparatus main body 30. The lowermost bundle of the sheet bundles mounted on the stack tray 411 after bundle offsetting is offset toward this side. As a result, visual inspection is made easier for the lowermost sheets, and inconveniences such as leaving a sheet behind or difficulty in removing are thus solved.

According to the copying machine 10 of the present embodiment, the two aligning plates 412 serving as aligning means including the deep-side aligning plate 412A and the this-side aligning plate 412B are arranged reciprocally forward and backward relative to the apparatus main body 30, and operate in response to the sheet width. It is, therefore, possible to mount sheets of various sizes on this side of the apparatus main body 30 as far as possible, thus facilitating the removal of sheets.

According to the copying machine 10 of the present embodiment, furthermore, there is provided the sheet presence detecting sensor S11 which detects the presence or absence of a sheet on the stack tray 411 in the finisher 400. If the absence of a sheet on the stack tray 411 is detected, therefore, alignment is accomplished on this side of the apparatus main body 30 by operating only the deep-side aligning plate 412A with reference to the this-side aligning plate 412B. If the presence of a sheet on the stack tray 411 is detected, inconveniences such as overlapping of sheet bundles and difficulty in removing a sheet bundle are solved by performing alignment at a position in a direction opposite to the aligning direction of the last sheet in the preceding job.

According to the copying machine 10 of the present embodiment, when sheet bundles are not offset, or when the staple mode is selected, control is applied so that only the deep-side aligning plate 412A is operated with reference to the this-side aligning plate 412B. It is, therefore, easier to remove sheet bundles on the stack tray 411 bundle-discharged on this side relative to the apparatus main body 30.

According to the copying machine 10 of the present embodiment, moreover, the finisher 400 is arranged within the width in the discharging direction of the frame of the printer 300. It is, therefore, possible to provide an image forming apparatus incorporating a finisher which is compact in size and permits space saving.

What is claimed is:

1. An image forming apparatus, comprising:

image forming means for forming an image on a sheet and feeding the image-formed sheet;

sheet stacking means for stacking the image-formed sheet to be discharged; and offset mounting means for shifting a plurality of sheet bundles on sides in a sheet bundle takeout direction and in a direction opposite thereto, and mounting the offset bundles onto said sheet stacking means, wherein said sheet stacking means and said offset mounting means are disposed in a space between an upper surface of a main body of said image forming apparatus and a reader disposed above said main body, and offset and mount sheets discharged from said main body, wherein when no sheet bundle is on said stacking means said offset mounting means shifts a first sheet bundle of a job on the side in the sheet bundle takeout direction, and when there is a sheet bundle of a preceding job on said sheet stacking means, said offset mounting means shifts said first sheet bundle in a direction opposite to that of the sheet bundle of the preceding job, wherein said offset mounting means includes shifting means for shifting a sheet in a direction crossing a sheet discharging direction, and the sheet bundles are offset through control by said shifting means, wherein said offset mounting means is disposed on an upstream side of said sheet stacking means, and further comprises conveying means for conveying the sheet bundles to said sheet stacking means, and wherein said offset mounting means further comprises a sheet stacking base onto which sheets are temporarily stacked and wherein said shifting means serves also as aligning means for conducting width-direction alignment of sheets on said sheet stacking base.

2. An image forming apparatus according to claim 1, wherein the sheet bundle takeout direction and the sheet discharging direction cross.

3. An image forming apparatus according to claim 1, wherein said aligning means includes first aligning means for aligning a deeper-side end of a sheet on said sheet stacking base relative to an apparatus main body, and second aligning means for aligning a thin-side end thereof relative to the apparatus main body.

* * * * *

UNITED STATES PATENT AND TRADEMARK OFFICE

CERTIFICATE OF CORRECTION

PATENT NO. : 6,963,722 B2
DATED : November 8, 2005
INVENTOR(S) : Yuzo Matsumoto et al.

It is certified that error appears in the above-identified patent and that said Letters Patent is hereby corrected as shown below:

Column 3,
Line 24, “illustrate” should read -- illustrates --.

Column 7,
Line 65, “time” should read -- times --.

Column 8,
Line 20, “imaged” should read -- image --.
Line 38, “ray” should read -- tray --.
Line 54, “in” should be deleted.

Column 10,
Line 52, “the” should be deleted.

Column 12,
Line 22, “row” should read -- now --.

Column 13,
Line 38, “describe” should read -- described --.

Column 18,
Line 5, “an other” should read -- another --.

Column 20,
Line 66, “tack” should read -- stack --.

Signed and Sealed this

Eleventh Day of April, 2006

JON W. DUDAS
*Director of the United States Patent and Trademark Office*